US011913709B2

(12) United States Patent
Hong

(10) Patent No.: US 11,913,709 B2
(45) Date of Patent: Feb. 27, 2024

(54) REFRIGERATOR AND HOME APPLIANCE

(71) Applicant: LG Electronics Inc., Seoul (KR)

(72) Inventor: Euddeum Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/859,450

(22) Filed: Jul. 7, 2022

(65) Prior Publication Data

US 2023/0009434 A1 Jan. 12, 2023

(30) Foreign Application Priority Data

Jul. 7, 2021 (KR) ..... 10-2021-0089383

(51) Int. Cl.
*F25D 23/02* (2006.01)
*F25D 23/10* (2006.01)

(52) U.S. Cl.
CPC ..... *F25D 23/028* (2013.01); *F25D 23/10* (2013.01); *F25D 2400/18* (2013.01)

(58) Field of Classification Search
CPC .... F25D 23/028; F25D 23/10; F25D 2400/18; F25D 23/02; F25D 11/00; E06B 3/7001; E06B 5/006; E06B 2003/7011; E06B 2003/7049
See application file for complete search history.

(56) References Cited

U.S. PATENT DOCUMENTS 5,358,326 A * 10/1994 Cherry ..... F25D 23/02 312/265.6
7,954,345 B2 * 6/2011 Park ..... D06F 39/14 68/139
8,485,615 B2 * 7/2013 Ciyanoglu ..... F25D 23/10 312/204
10,907,884 B1 * 2/2021 Scorsim ..... F25D 23/028
11,029,079 B1 * 6/2021 Lee ..... F25D 23/126
11,047,613 B1 * 6/2021 Park ..... F25D 23/02
11,320,192 B2 * 5/2022 Lee ..... E06B 3/4627
(Continued)

FOREIGN PATENT DOCUMENTS

CN 113865232 A * 12/2021
JP H0722382 U 4/1995
(Continued)

OTHER PUBLICATIONS

Extended Search Report in European Appln. No. 22183486.4, dated Nov. 23, 2022, 9 pages.

*Primary Examiner* — Hanh V Tran
(74) *Attorney, Agent, or Firm* — Fish & Richardson P.C.

(57) ABSTRACT

A refrigerator and a home appliance include a cabinet with a storage space formed therein, and a door configured to open and close the storage space, and including a door body filled with an insulator and a door panel detachably mounted on a front surface of the door body, where the door panel includes a panel defining a front appearance of the door, and a panel bracket extending along at least one end of a perimeter of a rear surface of the panel and coupled to the door body, and the panel bracket includes a coupling part coupled to the rear surface of the panel, a support part formed along an end of the coupling part and configured to support an end of the panel, and a mounting part protruding rearward from a rear surface of the coupling part and coupled to the door body.

20 Claims, 26 Drawing Sheets

(56) References Cited

U.S. PATENT DOCUMENTS

| | | | | |
|---|---|---|---|---|
| 11,402,147 | B2 * | 8/2022 | Lee | F25D 23/02 |
| 2007/0188059 | A1 * | 8/2007 | Davis | F25D 23/02 312/265.6 |
| 2016/0341468 | A1 * | 11/2016 | Joo | F25D 11/02 |
| 2017/0370631 | A1 * | 12/2017 | Kim | F25D 23/006 |
| 2018/0187955 | A1 * | 7/2018 | Son | F25D 23/028 |
| 2020/0072544 | A1 * | 3/2020 | Lee | F25D 29/005 |
| 2020/0284503 | A1 * | 9/2020 | Gerstmayr | F25D 23/028 |
| 2020/0323342 | A1 * | 10/2020 | Chavan | F25D 25/02 |
| 2020/0326119 | A1 * | 10/2020 | Lee | F25D 23/028 |
| 2021/0055038 | A1 * | 2/2021 | Lee | F25D 23/028 |
| 2021/0071934 | A1 * | 3/2021 | Lee | E06B 3/4627 |
| 2021/0071935 | A1 | 3/2021 | Lee et al. | |
| 2021/0372688 | A1 * | 12/2021 | Kang | F25D 23/02 |
| 2021/0396456 | A1 * | 12/2021 | Park | F25D 23/067 |
| 2021/0396458 | A1 * | 12/2021 | Moon | A47B 96/20 |
| 2022/0003494 | A1 * | 1/2022 | Kwon | F25D 25/005 |

FOREIGN PATENT DOCUMENTS

| | | | |
|---|---|---|---|
| JP | 2016156556 | A | 9/2016 |
| JP | 6460832 | | 1/2019 |
| WO | WO 2021/112658 | | 6/2021 |

* cited by examiner

REFRIGERATOR AND HOME APPLIANCE

CROSS-REFERENCE TO RELATED APPLICATIONS

This application claims priority under 35 U.S.C. 119 and 365 to Korean Patent Application No. 10-2021-0089383, filed on Jul. 7, 2021 in the Korean Intellectual Property Office, the disclosure of which is incorporated herein by reference.

FIELD

The present disclosure relates to a refrigerator and a home appliance.

BACKGROUND

In general, a refrigerator is a home appliance for storing food at low temperature in an internal storage space that is shielded by a refrigerator door, and is configured to store the stored food in an optimal state by cooling the inside of the storage space using cold air generated through heat exchange with a refrigerant circulating through the refrigeration cycle.

Such a refrigerator is gradually being enlarged and multi-functional according to a trend of changes in dietary life and high-quality products, and a refrigerator equipped with various structures and convenience devices in consideration of user convenience is being developed.

In order to harmonize with an environment in which the refrigerator is disposed or with surrounding furniture or home appliances, structures for varying an outer appearance of a door front of the refrigerator are developed, and this situation is also applied to general home appliances in the same way.

Japanese Patent No. 6460832 discloses a structure in which a glass plane defining an outer appearance is mounted on a door front of a refrigerator. Disclosed is a structure in which a plurality of recessed grooves are formed in a front part of a door body, and a glass panel is mounted by forming an installation part bent in multiple stages on a rear surface of the glass panel and inserting the installation part into the recessed grooves. In addition, a structure in which an upper end of the glass panel is restrained by mounting a blocking part to limit upward flow of the glass panel is disclosed.

However, conventionally, a blocking part is fixedly mounted on a refrigerator door after the glass panel is mounted, and accordingly, there is a problem in that it is not possible to maintain a constant interval between the glass panel and the blocking part.

An end of the glass panel is separated from a covering part of a door front, and thus, there is a problem in that the glass panel is deformed or damaged when the glass panel is pressed from the front.

There is a problem in that the glass panel is damaged when an impact is applied to the end of the glass panel because a portion of a perimeter of the glass panel is exposed.

SUMMARY

An object of an embodiment of the present disclosure is to provide a refrigerator and a home appliance for improving the quality of assembly finish after a door panel is mounted.

An object of an embodiment of the present disclosure is to provide a refrigerator and a home appliance for preventing a door panel from being deformed and damaged.

An object of an embodiment of the present disclosure is to provide a refrigerator and a home appliance for improving the assembly workability of a door panel.

According to an embodiment of the present disclosure, a refrigerator and a home appliance includes a cabinet with a storage space formed therein, and a door configured to open and close the storage space, and including a door body filled with an insulator and a door panel detachably mounted on a front surface of the door body, wherein the door panel includes a panel defining a front appearance of the door, and a panel bracket extending along at least one end of a perimeter of a rear surface of the panel and coupled to the door body, and the panel bracket includes a coupling part coupled to the rear surface of the panel, a support part formed along an end of the coupling part and configured to support an end of the panel, and a mounting part protruding rearward from a rear surface of the coupling part and coupled to the door body.

In a state in which the door panel is mounted on the door body, the support part may be positioned at the same height as the door body.

In a state in which the door panel is mounted on the door body, a rear end of the support part may be in contact with a front end of the door body.

The support part may protrude forward to a position corresponding to a front surface of the panel.

The support part may be thinned as extending forward.

One surface of the support part, which is in contact with an end of the panel, may be formed in parallel to the panel, and another surface of the support part, defining an opposite surface to the one surface of the support part, may be inclined or rounded.

The panel may be formed of a metal plate, the panel may include a panel front part defining a front surface, and bending parts bent along upper and lower ends of the panel front part and in contact with the support part, and an accommodating groove, which is recessed along the support part and into which the bending parts are inserted, may be formed on a front surface of the panel bracket.

The support part may protrude forward from the coupling part and may support an end of the panel.

The support part may protrude from the coupling part by a thickness of the panel.

The coupling part may be adhered to the panel by an adhesive.

The door body may include an upper cap deco defining an upper surface of the door body, and the panel bracket may be provided at an upper end of a rear surface of the panel, and an upper surface of the panel bracket may be positioned at the same height as an upper surface of the upper cap deco.

The door body may further include a side deco defining both surfaces of the door, and a side support protruding at the same height as the support part and configured to support right and left ends of the panel may be formed at a front end of the side deco.

The side support part may protrude forward compared with the upper cap deco.

The upper cap deco may include an upper part defining an upper surface of the door, and a front part supporting the coupling part from a rear, and an accommodation part, which is recessed with a size and a shape corresponding to the mounting part and on which the mounting part is accommodated, may be formed on the front part.

When the mounting part is mounted on the accommodation part, an end of the panel bracket may be aligned to be positioned at the same line as an end of the upper cap deco.

The accommodation part may include an accommodation part support surface supporting a bottom surface of the mounting part, and an accommodation part edge extending upward along a perimeter of the accommodation part support surface and in contact with a perimeter of the mounting part, and an accommodation part screw hole coupled through the mounting part may be formed in the accommodation part support surface.

The mounting part may include a mounting part support surface extending in a direction crossing a coupling surface and supported by the accommodation part, and a plurality of reinforcing ribs connecting the mounting part support surface and the coupling surface, and a mounting part screw hole coupled to the accommodation part through the mounting part support surface may be formed in the mounting part support surface.

An open deco opening may be formed on an upper surface of the upper cap deco to expose the accommodation part, and a deco cover for shielding the deco opening may be detachably mounted on the deco opening in a state in which the mounting part is mounted on the accommodation part.

A shielding part protruding rearward at a position corresponding to the mounting part and shielding at least a portion of an open upper surface of the accommodation part may be formed on an upper end of the coupling part.

The door body may include a lower cap deco defining a lower surface of the door body, and the panel bracket may be further provided at an upper end of a lower surface of the panel, and a lower surface of the panel bracket may be positioned at the same height as a lower surface of the lower cap deco.

DETAILED DESCRIPTION

Hereinafter, detailed embodiments will be described in detail with reference to the accompanying drawings. However, the present disclosure is limited to the embodiments in which the spirit of the present disclosure is proposed, and other degenerate idea or other embodiments included in the scope of the present disclosure may be easily proposed by addition, changes, deletions, etc. of other elements.

Prior to a description, directions are defined. In an embodiment of the present disclosure, a direction in which a front surface of a door is directed shown in FIG. is defined as a front direction, a direction toward a cabinet based on the front surface of the door is defined as a rearward direction, a direction toward a bottom on which a refrigerator is mounted is defined as a downward direction, and a direction away from the bottom is defined as an upward direction.

Figure 1:
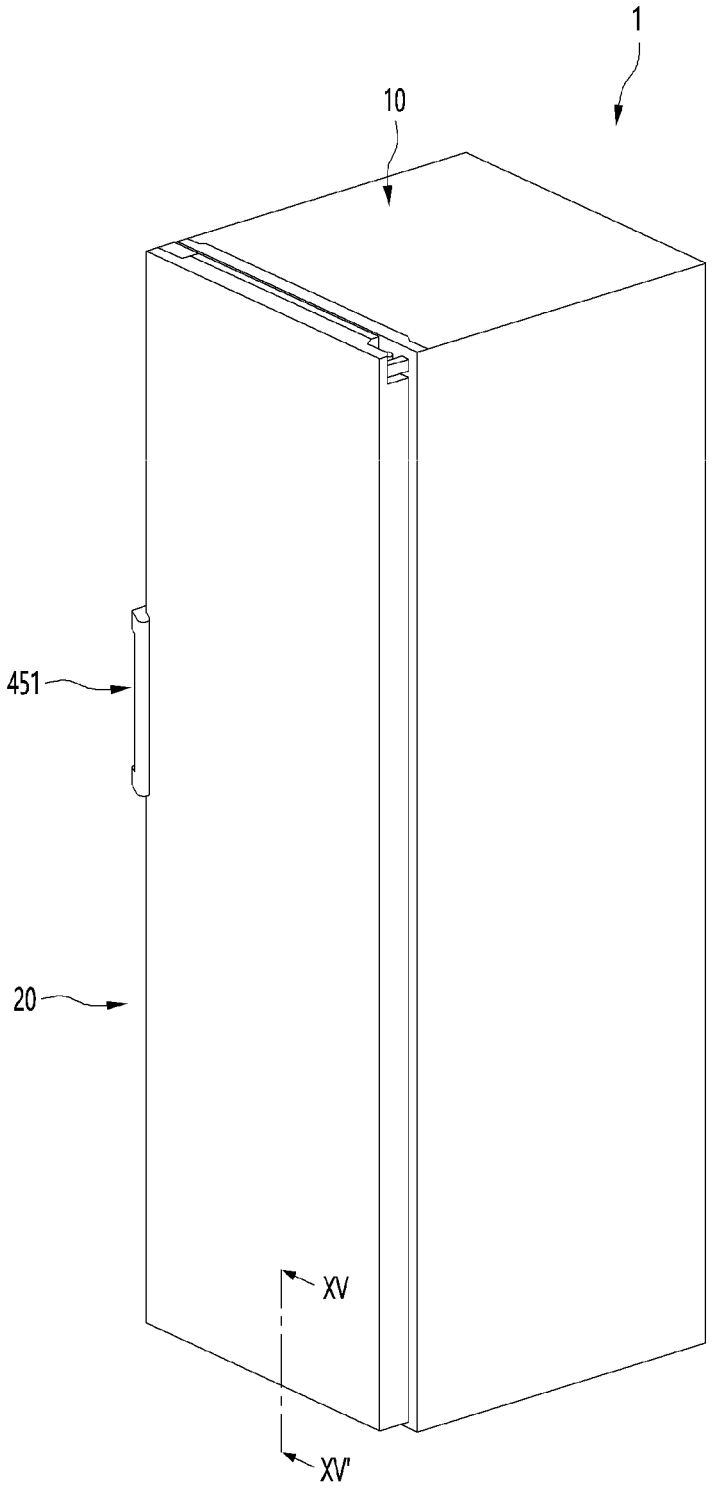
FIG. 1 is a perspective view of a refrigerator according to an embodiment of the present disclosure.

FIG. 1 is a perspective view of a refrigerator according to an embodiment of the present disclosure.

As shown in the drawing, a refrigerator 1 according to an embodiment of the present disclosure may include a cabinet 10 that defines a storage space, and a refrigerator door 20

(hereinafter referred to as the door 20) that is disposed in front of the cabinet 10 and opens and closes the storage space.

The storage space may have an open front surface, and may be divided into a plurality of spaces as necessary. The plurality of doors 20 may be provided to open and close the plurality of storage spaces, respectively. According to an embodiment of the pre sent disclosure, for convenience of description and understanding, although the refrigerator having one door 20 is exemplified, the present disclosure is not limited thereto, and is applicable to all types of refrigerators including a door.

The door 20 may be rotatably connected to the cabinet 10 by a hinge device. The hinge device may be provided at an upper end and a lower end of the door 20. Thus, a user may rotate and manipulate the door 20 using a handle 452 provided on the door 20 and may open and close the storage space.

Hereinafter, the structure of the door 20 will be described in more detail with reference to the drawings.

Figure 2:
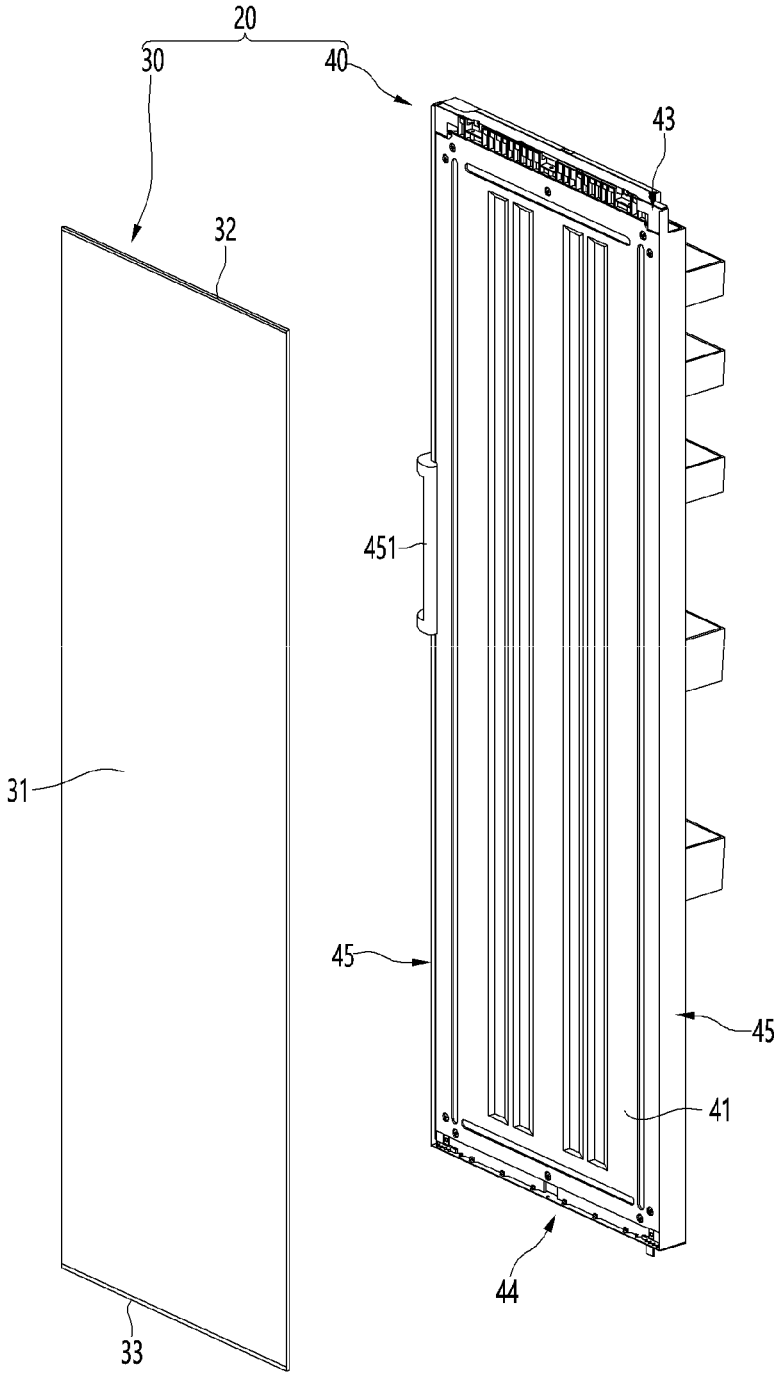
FIG. 2 is a perspective view of a refrigerator door according to an embodiment of the present disclosure.
Figure 3:
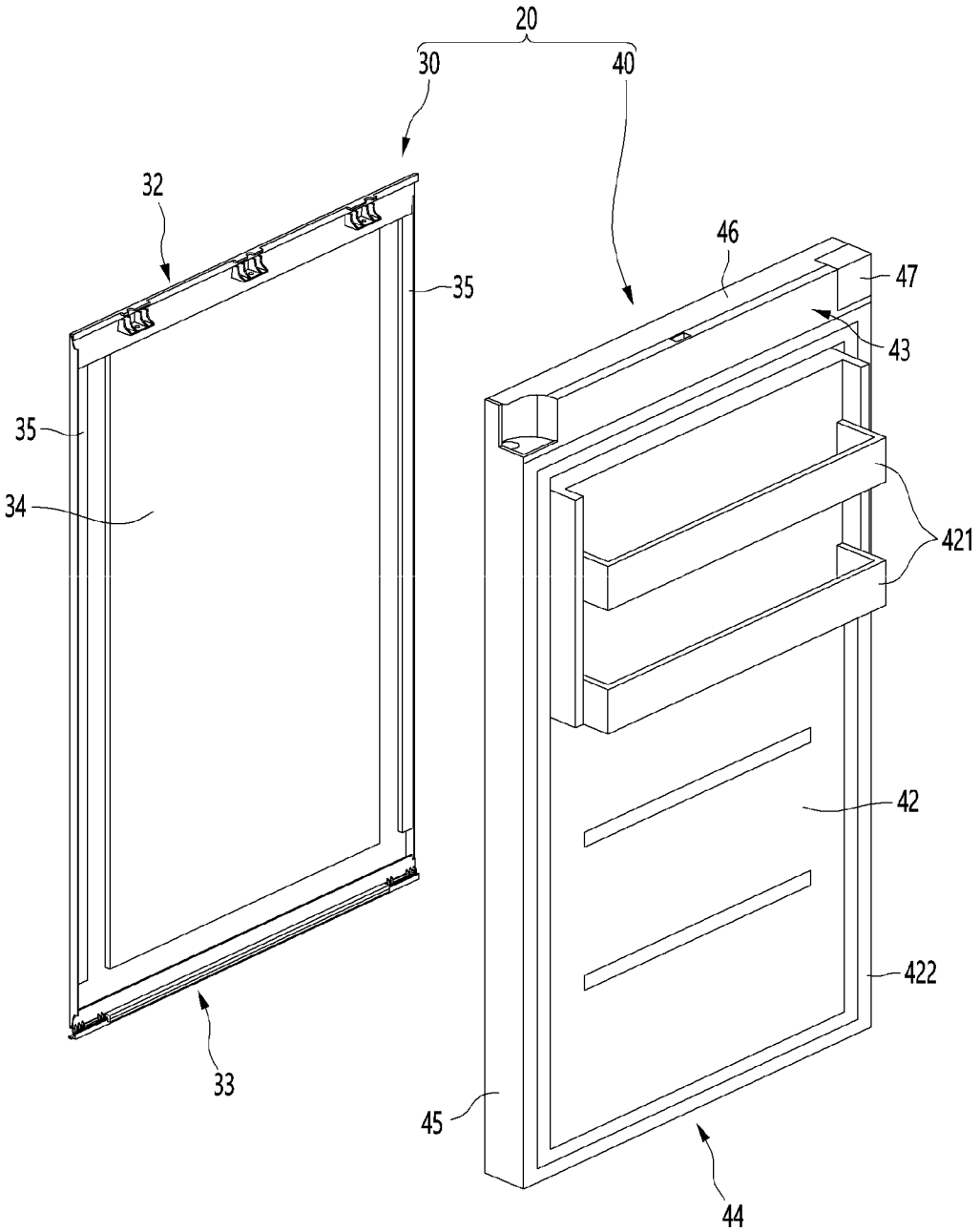
FIG. 3 is an exploded perspective view showing the case in which the refrigerator door is disassembled, viewed from the rear.
Figure 4:
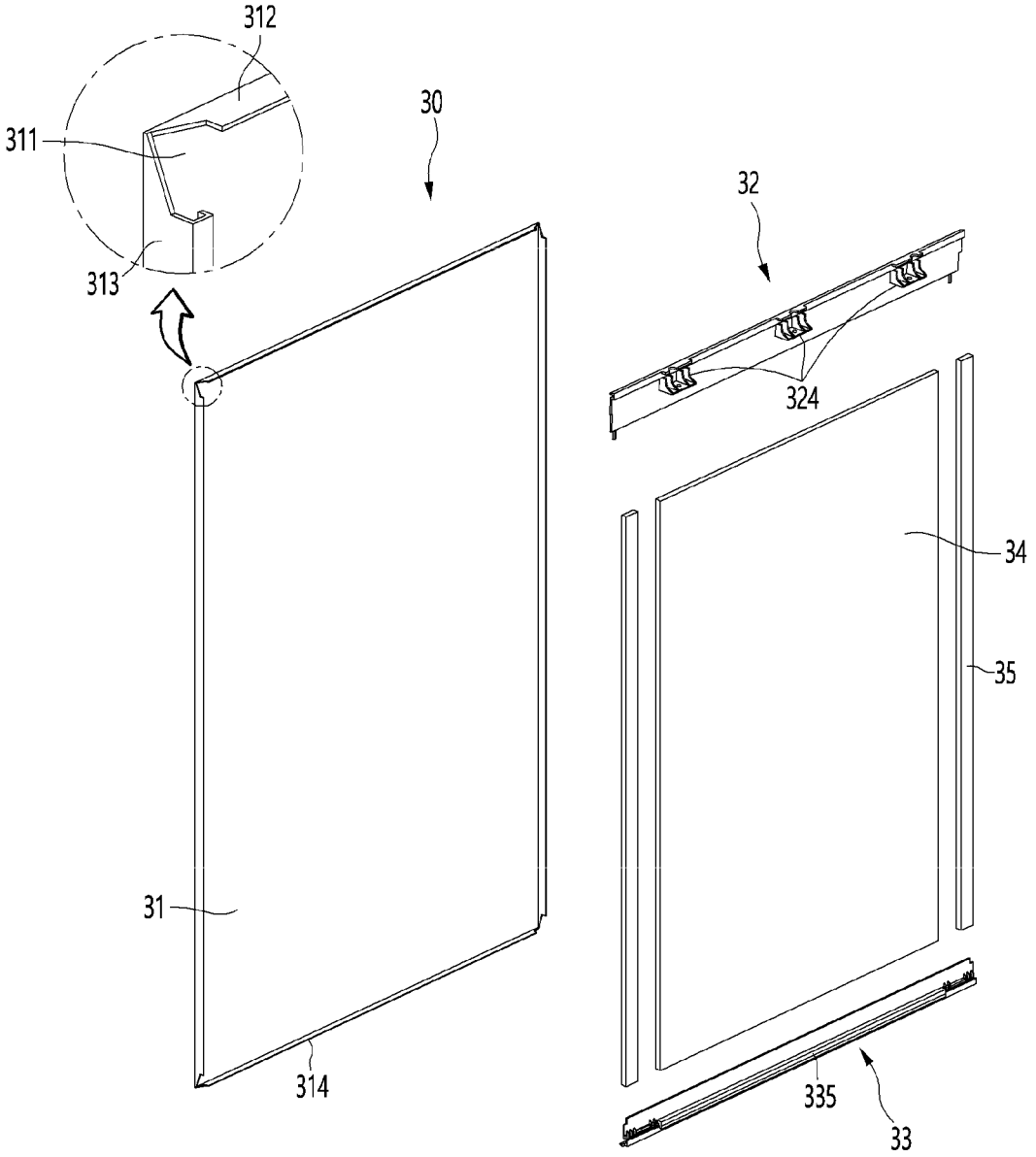
FIG. 4 is an exploded perspective view of a door panel that is a component of the refrigerator door.

FIG. 2 is an exploded perspective view of a refrigerator door according to an embodiment of the present disclosure. FIG. 3 is an exploded perspective view showing the case in which the refrigerator door is disassembled, viewed from the rear. FIG. 4 is an exploded perspective view of a door panel that is a component of the refrigerator door.

As shown in the drawings, the door 20 may include a door body 40 for opening and closing the storage space, and the door panel 30 that is coupled to the door body 40 and defines the front appearance of the door 20.

The door body 40 may define the overall shape of the door 20, and may substantially open and close and insulate the storage space. The door body 40 may be formed by coupling a body cover 41 defining a front surface, a door liner 42 defining a rear surface, an upper cap deco 43 defining an upper surface, a lower cap deco 44 defining a lower surface, and a side deco 45 defining right and left side surfaces.

The body cover 41 may define a front shape of the door body 40. The body cover 41 may be formed in a metal plate shape, and may be formed of an iron plate material to which a magnet 35 is capable of being attached. A plurality of screws 412 may be fastened around the body cover 41 to fixedly couple the body cover 41 to the upper cap deco 43, the lower cap deco 44, and the side deco 45.

The door liner 42 may be formed of a plastic material and may define a rear shape of the door body 40. A door basket 421 for accommodation may be mounted on the door liner 42. A gasket 422 may be provided on a perimeter of the door liner 42, and in the state in which the door 20 is closed, and may seal a portion between the door 20 and the cabinet 10.

The upper cap deco 43 may be coupled to an upper end of the body cover 41 and may define an upper appearance of the door body 40. The upper cap deco 43 may define an upper end of a front surface of the door body 40, and may be coupled to an upper bracket 32 of the door panel 30 when the door panel 30 is mounted.

The lower cap deco 44 may be coupled to lower ends of the body cover 41 and the door liner 42 to form a lower appearance of the door body 40. The lower cap deco 44 may define a lower front end of the door body 40 and may be coupled to a lower bracket 33 of the door panel 30 when the door panel 30 is mounted.

The side deco 45 may connect the body cover 41 to right and left ends of the body cover 41, the door liner 42, the upper cap deco 43, and the lower cap deco 44, and may define an outer appearance of right and left side surfaces of the door body 40. In addition, when the door panel 30 is mounted, the side deco 45 may support both right and left ends of the door panel 30. The handle 452 may be provided on the side deco 45 of one side surface away from a rotation axis of the door 20 among right and left surfaces.

The door panel 30 may define a front appearance of the door 20 and, as necessary, may be to be detached from the door body 40. For example, the door panel 30 may be manufactured to have various colors or textures, and may be selectively mounted on the door body 40 according to a user's preference. In addition, the outer appearance of the refrigerator 1 may be changed by replacing the door panel 30. Since the door panel 30 defines an outer appearance of the door 20 and the refrigerator 1, the door panel 30 may also be referred to as an outer panel and a panel assembly.

The door panel 30 may include the panel 31 defining an outer appearance, and a panel bracket provided on a rear surface of the panel 31 to mount the door panel 30 on the door body 40. The panel bracket may include at least one of the upper bracket 32 or the lower bracket 33.

The panel 31 may be formed of a plate-shaped material. For example, the panel 31 may be formed of a stainless steel plate material. The panel 31 may be formed of a plate-shaped material and may have a bent perimeter. In detail, the panel 31 may include a panel front part 311 defining a front appearance, and bending parts 312, 313, and 314 bent rearward along a perimeter of the panel front part 311. Since the panel 31 defines a front appearance of the door panel 30, the panel 31 may also be referred to as a front plate or a door plate.

The panel front part 311 may be formed in a rectangular shape to form a front surface of the door 20 and may be formed in a planar shape. The bending parts 312, 313, and 314 (refer to FIGS. 5 and 8) may include an upper bending part 312 formed along an upper end of the panel front part 311 and extending rearward perpendicular to the panel front part 311, and a lower bending part 314 formed along a lower end of the panel front part 311 and extending rearward perpendicular to the panel front part 311. The upper bending part 312 and the lower bending part 314 may be fixedly inserted into the upper bracket 32 and the lower bracket 33, respectively.

The bending parts 312, 313, and 314 may further include a side bending part 313 formed along both sides of the panel front part 311. A side bending part 313 may extend rearward perpendicularly to the panel front part 311, and the extending end may be further bent to be round inward again. Accordingly, when the door panel 30 is transported, the upper bending part 312 and the lower bending part 314 may be covered by the upper bracket 32 and the lower bracket 33, and an end of the side bending part 313 may be rounded, and accordingly, it may be possible to prevent safety accidents such as being cut or stabbed by a sharp end of the panel 31.

The upper bracket 32 may be provided on an upper end of the panel 31. The upper bracket 32 may have a length corresponding to a horizontal length of the panel and may be attached to an upper end of a rear surface of the panel 31. An upper end of the upper bracket 32 may protrude compared with the upper end of the panel 31 and may support the upper end of the panel 31 to protect the upper end of the panel 31 and to define an upper appearance of the door panel 30.

A mounting part 324 protruding rearward may be formed on a rear surface of the upper bracket 32. The mounting part 324 may be coupled to the upper cap deco 43 to fixedly mount the door panel 30 on the door body 40. As such, the upper bracket may define an upper end of the door panel 30, and simultaneously, may have a function of mounting the door panel 30 on the door body 40. The upper bracket 32 may be referred to as a first bracket.

The lower bracket 33 may be provided to oppose the upper bracket 32.

In detail, the lower bracket 33 may be provided at a lower end of the panel 31. The lower bracket 33 may have a length corresponding to a horizontal length of the panel 31 and may be attached to a lower end of the rear surface of the panel 31. The lower end of the lower bracket 33 may protrude compared with the lower end of the panel 31 and may support the lower end of the panel 31 to protect the lower end of the panel 31 and to define a lower appearance of the door panel 30.

A lower mounting part 334 protruding rearward may be formed on a rear surface of the lower bracket 33. The lower mounting part 334 may be coupled to the lower cap deco 44 and may fixedly mount the door panel 30 on the door body 40. As such, the lower bracket 33 may define a lower end of the door panel 30, and simultaneously, may have a function of mounting the door panel 30 on the door body 40. The lower bracket 33 may be referred to as a second bracket to be distinguished from the first bracket.

The door panel 30 may further include a buffer member 34. The buffer member 34 may be attached to the rear surface of the panel 31 and may fill a space between the panel 31 and the body cover 41 when the door panel 30 is mounted on the door body 40. Thus, even if an impact or pressure is applied to a front surface of the door panel 30, it may be possible to prevent the door panel 30 from being deformed or damaged. The buffer member 34 may be formed of an elastic material such as sponge, foam PU, or foam PE.

The door panel 30 may further include the magnet 35. The magnet 35 may be attached to the rear surface of the panel 31. When the door panel 30 is mounted on the door body 40, the magnet 35 may be attached to the body cover 41 via magnetic force. Thus, the door panel 30 may maintain a state of being temporarily fixed to the door body 40 by the magnet 35. The door panel 30 may maintain a more firmly mounted state to the door body 40 by the magnet 35. The magnet 35 may be vertically elongated and may be disposed between the upper bracket 32 and the lower bracket 33. In addition, the magnet 35 may be disposed on both right and left sides of the buffer member 34.

Hereinafter, structures of the upper cap deco 43 and the upper bracket 32 will be described in more detail with reference to the drawings.

Figure 5:
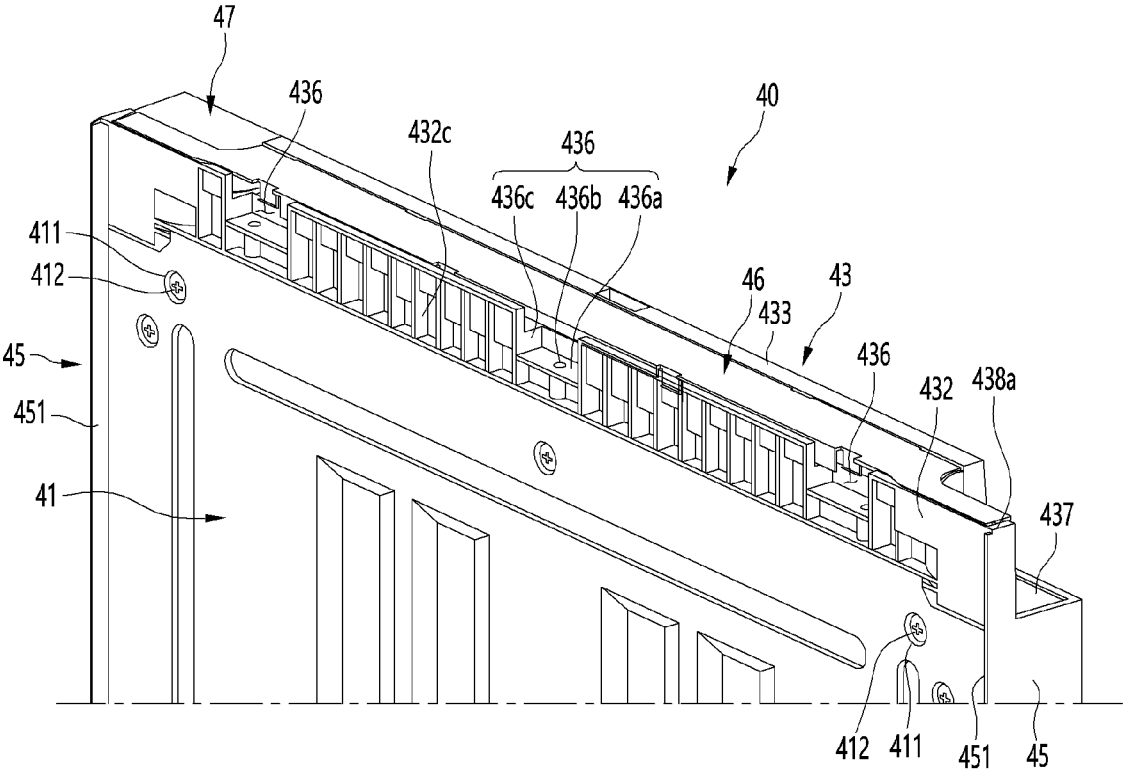
FIG. 5 is a partial perspective view showing an upper structure of a door body that is a component of the refrigerator door.
Figure 6:
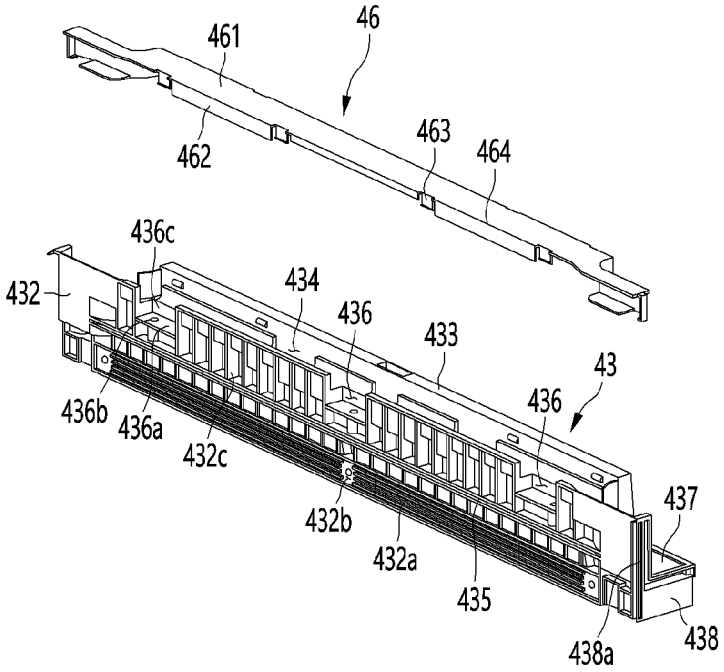
FIG. 6 is an exploded perspective view showing the state in which an upper cap deco and a deco cover of the refrigerator door are disassembled, viewed from the front.
Figure 7:
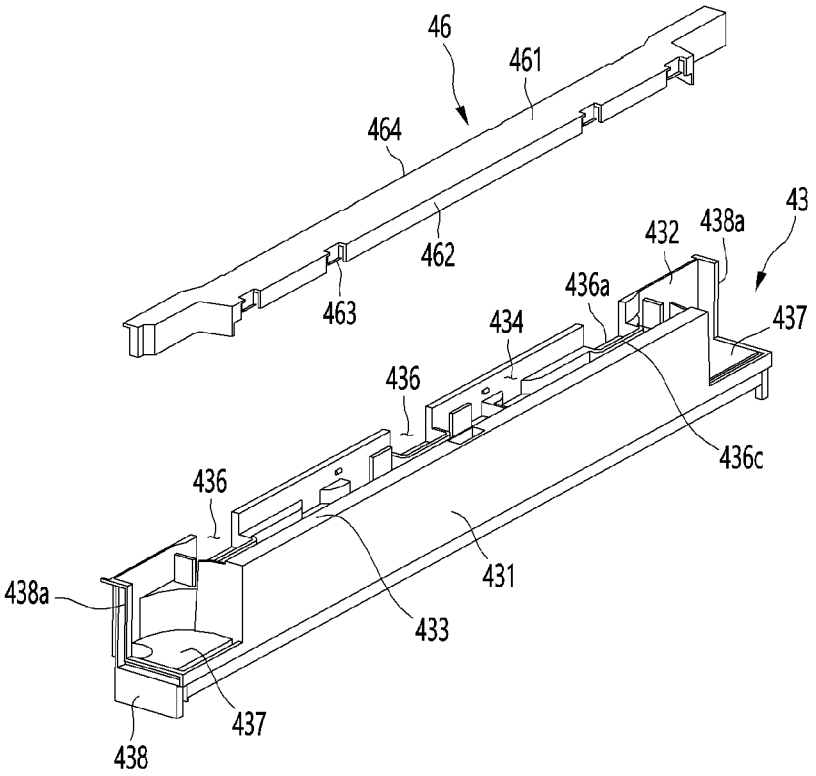
FIG. 7 is an exploded perspective view showing the state in which the upper cap deco and the deco cover are disassembled, viewed from the rear.

FIG. 5 is a partial perspective view showing an upper structure of a door body that is a component of the refrigerator door. FIG. 6 is an exploded perspective view showing the state in which an upper cap deco and a deco cover of the refrigerator door are disassembled, viewed from the front. FIG. 7 is an exploded perspective view showing the state in which the upper cap deco and the deco cover are disassembled, viewed from the rear.

As shown in the drawings, the upper cap deco 43 may be mounted on an upper end of the door body 40 to define an upper portion of the upper end of the door body 40. Rear, front, and upper surfaces of the upper cap deco 43 may be exposed to the outside in the state in which the upper cap deco 43 is mounted on the door body 40.

In detail, the upper cap deco 43 may include a rear part 431 defining a rear surface, a front part 432 defining a front surface, an upper part 433 defining an upper surface, and a side part 438 defining both right and left surfaces.

A lower end of the rear part 431 may be coupled to an upper end of the door liner 42, and may be formed in a plate shape. The rear part 431 may be exposed rearward in the state of being mounted on the door body 40 and may define an outer appearance of an upper end of the rear surface of the door body 40.

A lower end of the front part 432 may be coupled to an upper end of the body cover 41. The front part 432 may be exposed forward in the state of being mounted on the door body 40 and may define an outer appearance of an upper end of the front surface of the door body 40.

A cover coupling part 432*a* may be formed at a lower end of the front part 432. A deco screw hole 432*b* may be formed in the cover coupling part 432*a*, and may be formed at a position corresponding to a cover screw hole 411 formed in the body cover 41. The body cover 41 may be coupled to the upper cap deco 43 by a screw 412 coupled through the cover screw hole 411 and the deco screw hole 432*b*.

A cover groove 435 may be formed at an upper end of the cover coupling part 432*a*. The cover groove 435 may be a groove into which a cover bending part 413 bent at an upper end of the body cover 41, and the cover bending part 413 may be primarily fixed by inserting the cover bending part 413 thereinto before the screw 412 is coupled.

A plurality of support ribs 432*c* may be formed above the cover groove 435. The support ribs 432*c* may extend up and down and may extend to an upper end of the front part 432 from an upper portion of the cover groove 435. The plurality of support ribs 432*c* may be continuously arranged at regular intervals, and when the door panel 30 is mounted, the door panel 30 may be in contact with a rear surface of the upper bracket 32 to support the upper bracket 32 from the rear.

The plurality of support ribs 432*c* may be arranged at regular intervals, may reinforce the strength of the front part 432 to prevent the upper cap deco 43 from being deformed, and may stably support the upper end of the door panel 30 from the rear.

An accommodation part 436 on which the mounting part 324 of the door panel 30 is accommodated may be formed on the front part 432. The accommodation part 436 may be formed at a position corresponding to the mounting part 324, and when the door panel 30 is positioned at an accurate position, the mounting part 324 may be inserted into the inside of the accommodation part 436 and may be accommodated thereon. The accommodation parts 436 may be formed in the number corresponding to the mounting parts 324, and the plurality of accommodation parts 436 may be arranged in a longitudinal direction of the upper cap deco 43. For example, the accommodation part 436 may be formed at a horizontal center and at left and right sides of the upper cap deco 43.

The accommodation part 436 may be recessed downward from an upper end of the front part 432, that is, a front end of the upper part 433. The accommodation part 436 may have an open front surface, which is exposed through the front part 432, and may be opened with a size corresponding to the mounting part 324 to allow the mounting part 324 to be inserted and mounted rearward from the front.

The accommodation part 436 may include an accommodation part support surface 436*a* for supporting the mounting part 324. The accommodation part support surface 436*a* may define a bottom surface of the accommodation part 436 and may be formed to allow a mounting part support part 324*a* to be described below to be accommodated thereon. The accommodation part 436 may be positioned below the upper part 433 and may be formed in parallel to the upper part 433.

An accommodation part screw hole 436*b* may be formed in the accommodation part support surface 436*a*. Thus, in the state in which the mounting part 324 is accommodated on the accommodation part support surface 436*a*, a screw 48 passing through the mounting part 324 may be coupled to the accommodation part support surface 436*a*.

An accommodation part edge 436*c* may be formed on a perimeter of the accommodation part support surface 436*a*. The accommodation part edge 436*c* may extend upward, and in the state in which the mounting part 324 is accommodated on the accommodation part 436, the mounting part 324 may be in contact with a perimeter of the mounting part support part 324*a*. Thus, in the state in which the mounting part 324 is inserted into the accommodation part 436, the mounting part 324 and the accommodation part 436 may be coupled to be engaged with each other, and the door panel 30 may be fixed at an accurate position.

The accommodation part 436 may have an upper surface opened toward the upper part 433, and the open upper surface of the accommodation part 436 may be shielded by a shielding part 325 and a deco cover 46 that will be described below.

The upper part 433 of the upper cap deco 43 may connect upper ends of the rear part 431 and the front part 432 and may define an upper surface of the door body 40. A deco opening 434 recessed downward may be formed on the upper part 433. The deco opening 434 may define a space with an open upper surface and may have the accommodation part 436 disposed therein. The deco opening 434 may provide a space for accommodating an electrical component such as a sensor or a PCB when the electrical component is disposed in the door 20.

The deco opening 434 may be shielded by the deco cover 46. The deco cover 46 may be formed in a corresponding shape to shield the deco opening 434. The deco cover 46 may be detachably mounted on the deco opening 434 to easily perform an operation of coupling and decoupling between the upper bracket 32 and the upper cap deco 43.

The deco cover 46 may include a cover upper surface 461 for shielding the deco cover 46, and a cover edge 462 extending downward along a perimeter of the cover upper surface 461. A hook 463 may be formed on the cover edge 462, and the hook 463 may be caught and restrained inside the deco opening 434 to maintain the state in which the deco cover 46 is mounted.

A cover recess 464 may be formed on a front surface of the deco cover 46. The cover recess 464 may be formed in a shape corresponding to a front end of the deco opening 434 and may be formed in contact with a rear end of the shielding part 325 of the upper bracket 32, which will be described below.

Figure 10:
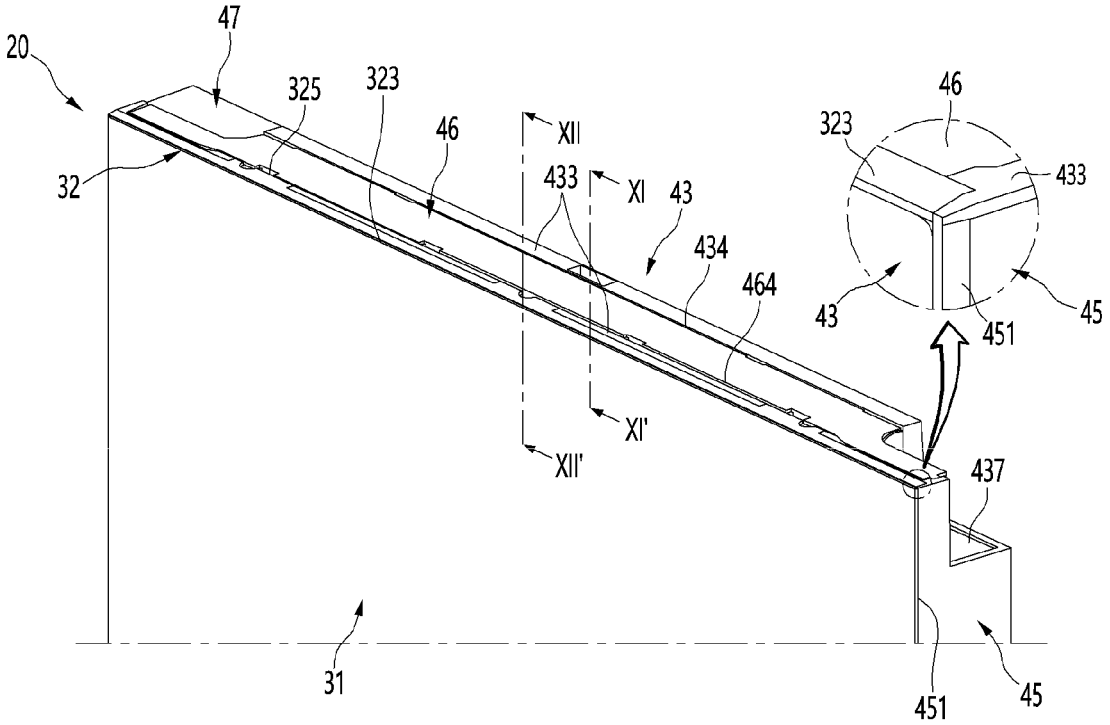
FIG. 10 is a partial perspective view of an upper part of the refrigerator door.

As shown in FIG. 10, in the state in which the deco cover 46 is mounted, the upper surface of the door body 40 may be formed by the upper part 433 of the upper cap deco 43, the cover upper surface 461 of the deco cover 46, and the shielding part 325 and a support part 323 of the upper bracket 32.

A hinge mounting part 437 recessed downward may be formed at right and left sides of the upper part 433. The hinge mounting part 437 may be a part on which a hinge device as a rotation axis of the door 20 is mounted and may be formed at right and left sides. The hinge device may be mounted at one side of the hinge mounting parts 437 at right and left sides in a rotation in which the door 20 is rotated. A mounting part cover 47 may be mounted at the hinge mounting part 437 at the other side, on which the hinge device is not mounted.

A side part of the upper cap deco 43 may be formed on right and left surfaces of the upper cap deco 43. A side part edge 438*a* may be formed along a perimeter of the side part 438. The side part 438 may be shielded by the side deco 45, and the side part edge 438*a* may be formed along a perimeter of the side deco 45 and may be adhered and coupled to the perimeter of the side deco 45.

The upper bracket 32 may be disposed in front of the upper cap deco 43 and may be mounted on the upper cap deco 43 when the door panel 30 is mounted.

Figure 8:
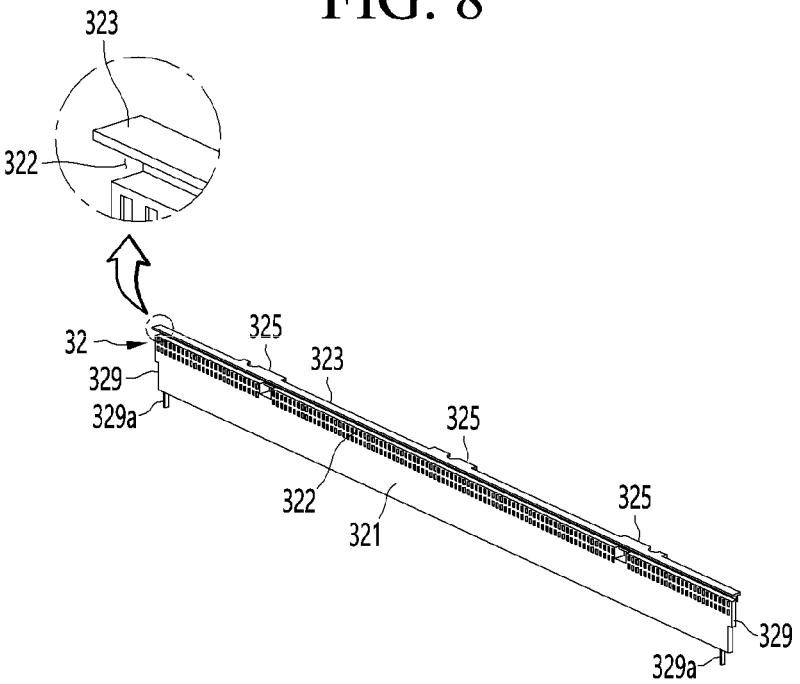
FIG. 8 is a perspective view of an upper bracket of the refrigerator door, viewed from the front.
Figure 9:
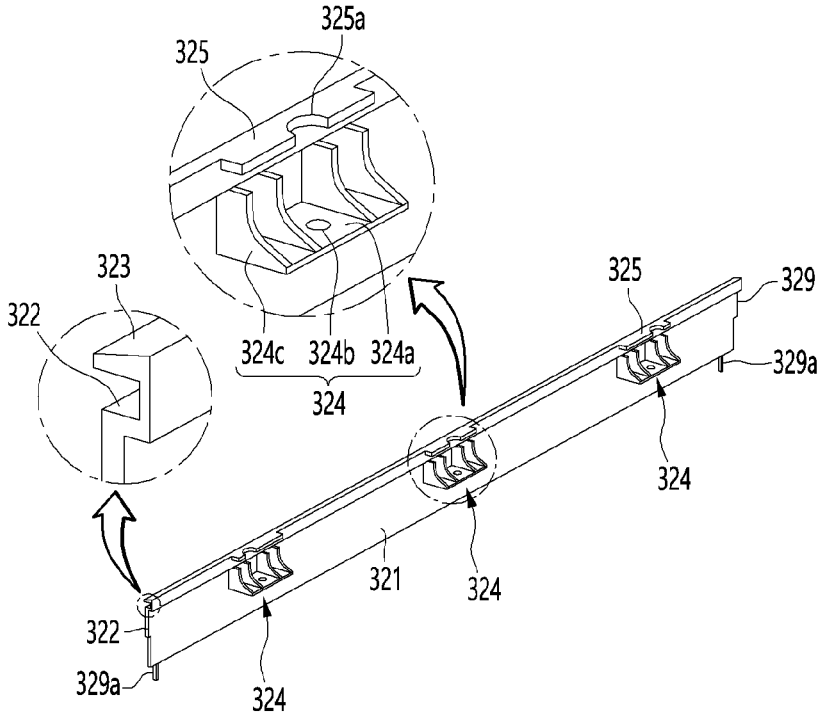
FIG. 9 is a perspective view of the upper bracket viewed from the rear.

FIG. 8 is a perspective view showing an upper bracket as a component of the refrigerator, viewed from the front. FIG. 9 is a perspective view of the upper bracket, viewed from the rear.

As shown in the drawings, the upper bracket 32 may be formed of a plastic material, and may include a coupling part 321 coupled to the rear surface of the panel 31, the support part 323 formed at an upper end of the front surface of the coupling part 321, and the mounting part 324 protruding rearward from the rear surface of the coupling part 321.

In detail, the coupling part 321 may be attached to the rear surface of the panel 31 and may be formed in a plate shape having a predetermined area. A horizontal width of the coupling part 321 may be formed to correspond to a horizontal length of the panel 31.

An adhesive may be applied to a front surface of the coupling part 321 or a member for bonding such as a double-sided tape may be disposed on the front surface. Accordingly, the coupling part 321 may maintain a state of being completely adhered to the rear surface of the panel 31.

An upper accommodating groove 322 may be formed at an upper portion of the coupling part 321. The upper accommodating groove 322 may extend from one end of the upper bracket 32 to the other end, and may be recessed to allow the upper bending part 312 of the panel 31 to be inserted thereinto. Accordingly, in the panel 31, the upper bending part 312 may be inserted into the upper accommodating groove 322, and simultaneously, the front surface of the coupling part 321 may be bonded to the rear surface of the panel 31. In addition, the upper bracket 32 may be assembled with the upper cap deco 43 in the state of being coupled to the panel 31.

The support part 323 may be formed at the upper end of the upper bracket 32. The support part 323 may be formed above the coupling part 321 and may protrude forward from the upper end of the upper accommodating groove 322. Thus, the support part 323 may support the upper end of the upper bending part 312 and may be in contact with the upper end of the panel 31. In this case, the upper bracket 32 may maintain the state in which the upper bending part 312 and the support part 323 are in close contact with each other in the state in which the coupling part 321 is adhered to the panel 31, and may prevent an interval between the panel 31 and the support part 323 from being widened when the door panel 30 is viewed from the front.

The support part 323 may protrude to a position corresponding to a front plate of the panel 31, and thus, the support part 323 may define an upper appearance of the door panel 30 while supporting the upper end of the panel 31. The support part 323 may support the upper end of the panel 31 to restrain an upward flow of the panel 31 and to simultaneously protect the upper end of the panel 31 from being damaged by impact.

The support part 323 may be formed to have a thinner thickness as protruding forward, and may be inclined or rounded to minimize exposure of the support part 323 when viewed from the front.

The mounting part 324 may protrude rearward from the rear surface of the coupling part 321. The mounting part 324 may protrude at a position corresponding to the accommodation part 436 and may be inserted into and accommodated on the accommodation part 436.

In detail, the mounting part 324 may include the mounting part support part 324*a* protruding rearward from the coupling part 321. The mounting part support part 324*a* may be formed at a height corresponding to the accommodation part support surface 436*a*, and may be formed in a shape corresponding to the accommodation part support surface 436*a*. For example, the mounting part support part 324*a* may be formed in a rectangular shape viewed from the above. When the mounting part 324 is mounted on the accommodation part 436, the mounting part support part 324*a* may be inserted into the inside of the accommodation part 436 and may surface-contact and may be accommodated on the upper surface of the accommodation part support surface 436*a*.

A mounting part screw hole 324*b* may be formed in the mounting part support part 324*a*. The mounting part screw hole 324*b* may be formed on the same extension line as the accommodation part screw hole 436*b* and may be formed to allow the screw 48 to be coupled thereto in the state in which the mounting part 324 is mounted on the accommodation part 436.

A reinforcing rib 324*c* may be formed between the upper surface of the mounting part support part 324*a* and the rear surface of the coupling part 321. The reinforcing rib 324*c* may extend to cross each of the coupling part 321 and the mounting part 324 and may connect the coupling part 321 and the mounting part 324 to each other. The plurality of reinforcing ribs 324*c* may be continuously arranged at regular intervals. Even if a load is applied to the mounting part support part 324*a* by the reinforcing rib 324*c*, the mounting part support part 324*a* may be prevented from being deformed or damaged.

The shielding part 325 protruding rearward may be further formed on the upper end of the coupling part 321, that is, the upper end of the upper bracket 32. The shielding parts 325 may be formed in the number corresponding to the mounting parts 324 at a position corresponding thereto. In detail, the shielding part 325 may be disposed vertically above the mounting part 324 and may be formed to have the same width as that of the mounting part 324. Accordingly, when the mounting part 324 is inserted into and mounted on the accommodation part 436, the shielding part 325 may shield an open upper surface of the accommodation part 436.

A shielding part groove 325*a* may be formed on the shielding part 325. The shielding part groove 325*a* may be formed on the same extension line as the mounting part screw hole 324*b*. Accordingly, the screw 48 may be coupled to or decoupled from the mounting part screw hole 324*b* by inserting a tool such as a driver into the mounting part screw hole 324*b* through the shielding part groove 325*a*, and a coupling state of the screw 48 may be checked through the shielding part groove 325*a*.

Bracket sides 329 to be coupled to the side deco 45 may be formed at right and left ends of the upper bracket 32. A guide protrusion 329*a* extending downward may be formed at right and left sides of a lower end of the upper bracket 32, that is, a lower end of the coupling part 321. The guide protrusion 329*a* may protrude downward at a corresponding to a position at which the magnet 35 is disposed. Thus, when the magnet 35 is mounted, an upper end of a side surface of the magnet 35 may be in contact with the guide protrusion 329*a*, and thus arrangement of the magnet 35 may be guided.

Hereinafter, with reference to the drawings, a coupling state of the upper bracket 32 and the upper cap deco 43 will be described in more detail.

Figure 11:
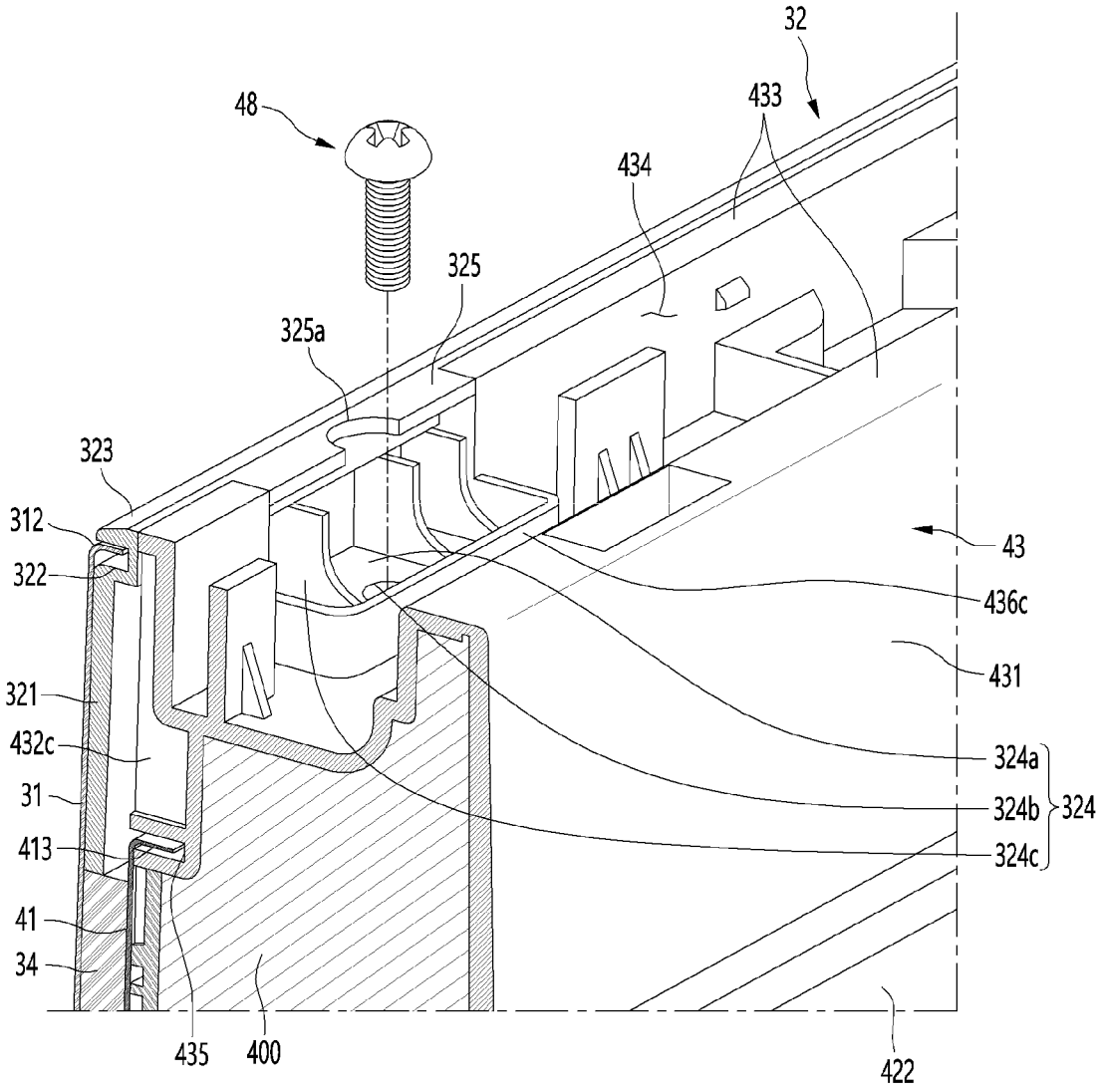
FIG. 11 is a perspective view taken along XI-XI' of FIG. 10.
Figure 12:
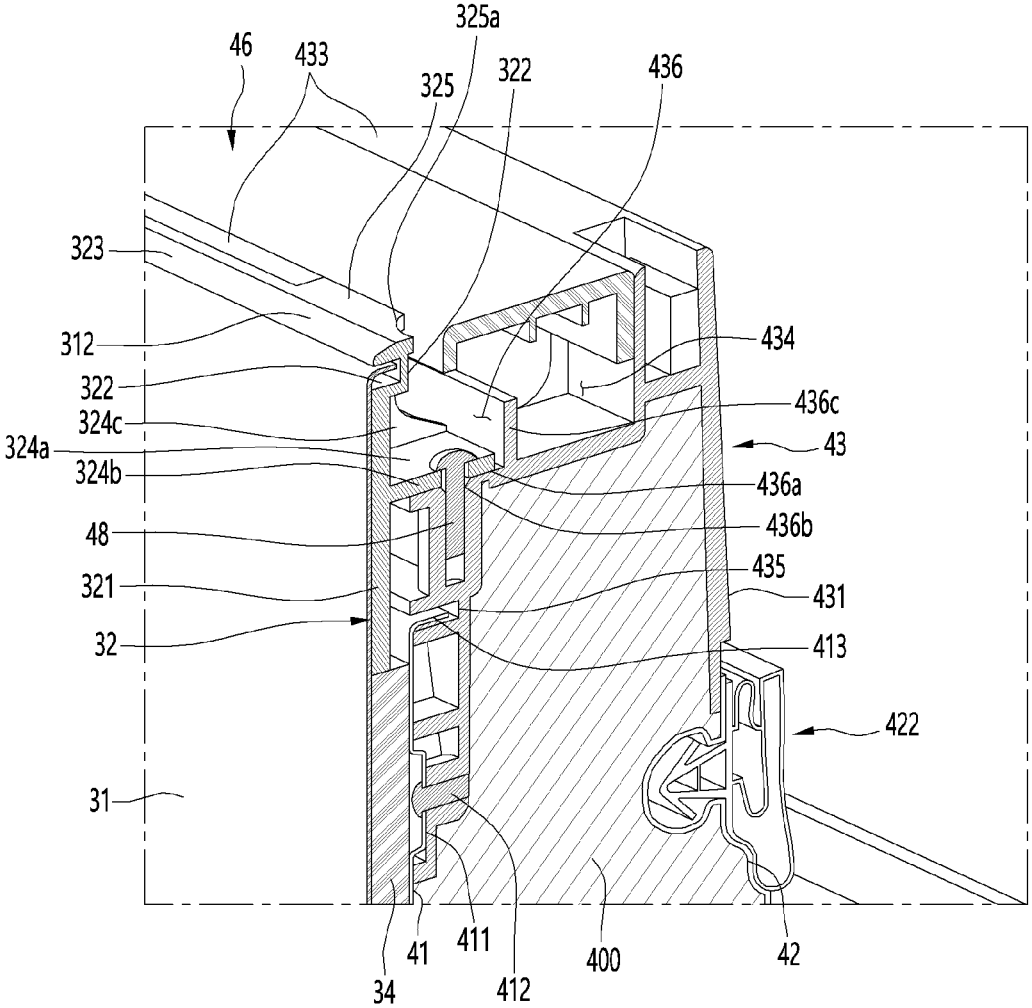
FIG. 12 is a perspective view taken along XII-XII' of FIG. 10.

FIG. 10 is a partial perspective view showing an upper part of the refrigerator door. FIG. 11 is a perspective view taken along XI-XI' of FIG. 10. FIG. 12 is a perspective view taken along XII-XII' of FIG. 10.

As shown in the drawings, the upper cap deco 43 may be prepared in the state of being attached to the panel 31. In this case, the upper bending part 312 of the panel 31 may be inserted into the inside of the upper accommodating groove 322. Accordingly, during transport and assembly, the sharp upper bending part 312 of the panel 31 may not be exposed, and the door panel 30 may be simply mounted on the door body 40.

In the state in which the upper bending part 312 of the panel 31 is inserted into the inside of the upper accommodating groove 322, the upper bracket 32 may be maintained to be attached to the panel 31. Thus, the panel 31 and the support part 323 may be maintained to be attached to each other, and in any case, an interval may not be generated between the upper end of the panel 31 and the support part 323.

In order to mount the door panel 30, the door panel 30 may be brought to the front surface of the door body 40. In this case, the door panel 30 may be mounted by disposing right and left ends of the panel 31 between the side deco 45.

In this case, in the state in which the lower end of the door panel 30 is caught and restrained by the lower cap deco 44, the upper end of the door panel 30 may be coupled to the upper cap deco 43. A coupling structure between the lower end of the door panel 30 and the lower cap deco 44 will be described in more detail.

When the door panel 30 is mounted, the mounting part 24 may be inserted into the inside of the accommodation part 436. In this case, the plurality of mounting parts 324 may be simultaneously inserted into the inside of the plurality of accommodation parts 436. Because the mounting part 324 is formed with a size and shape corresponding to the accommodation part 436, the door panel 30 may be aligned at an accurate position in a process in which the mounting part 324 is inserted into the accommodation part 436.

In this case, the mounting part support part 324*a* may be accommodated on the upper surface of the accommodation part support surface 436*a*. The mounting part support part 324*a* may be superimposed on the accommodation part support surface 436*a*, may be in contact with the accommodation part edge 436*c*, may not flow, and may be maintained at an accurate mounting position. When the mounting part support part 324*a* is completely inserted into the inside the accommodation part 436, the mounting part screw hole 324*b* and the accommodation part screw hole 436*b* may be aligned, and the screw 48 may be coupled through the mounting part screw hole 324*b* and the accommodation part screw hole 436*b*. The door panel 30 may be firmly fixed to the door body 40 by coupling the screw 48.

After the door panel 30 is completely mounted by coupling the screw 48, the deco cover 46 may be mounted on the open upper surface of the deco opening 434 to shield the deco opening 434. In this case, the accommodation part 436 inside the deco opening 434 may be shielded not to be exposed to the outside by the deco cover 46.

In order to mount the door panel 30 on the door body 40, when the mounting part 324 is accommodated on the accommodation part 436, the shielding part 325 may shield the open upper surface of the accommodation part 436. The shielding part 325 may be disposed on the same plan together with the upper part 433 and the upper surface of the deco cover 46 to define an upper appearance of the door 20.

Even if compressive force is applied to the front surface of the panel 31 during use in the state in which the door panel 30 is mounted, the front part 432 of the upper cap deco 43, that is, the support ribs 432*c* may be maintained to support the coupling part 321 of the upper bracket 32, thereby originally preventing the door panel 30 from being pressed or moved rearward and being deformed.

The upper bracket 32 is mounted in the state of being already coupled to the panel 31, and thus the upper end of the panel 31 and the support part 323 may be maintained to be in close contact with each other. Thus, while the door 20 is used, it may be possible to prevent an interval between the upper end of the panel 31 and the support part 323 from being widened.

Hereinafter, the structures of the lower cap deco 44 and the lower bracket 33 will be described in more detail with reference to the drawings.

Figure 13:
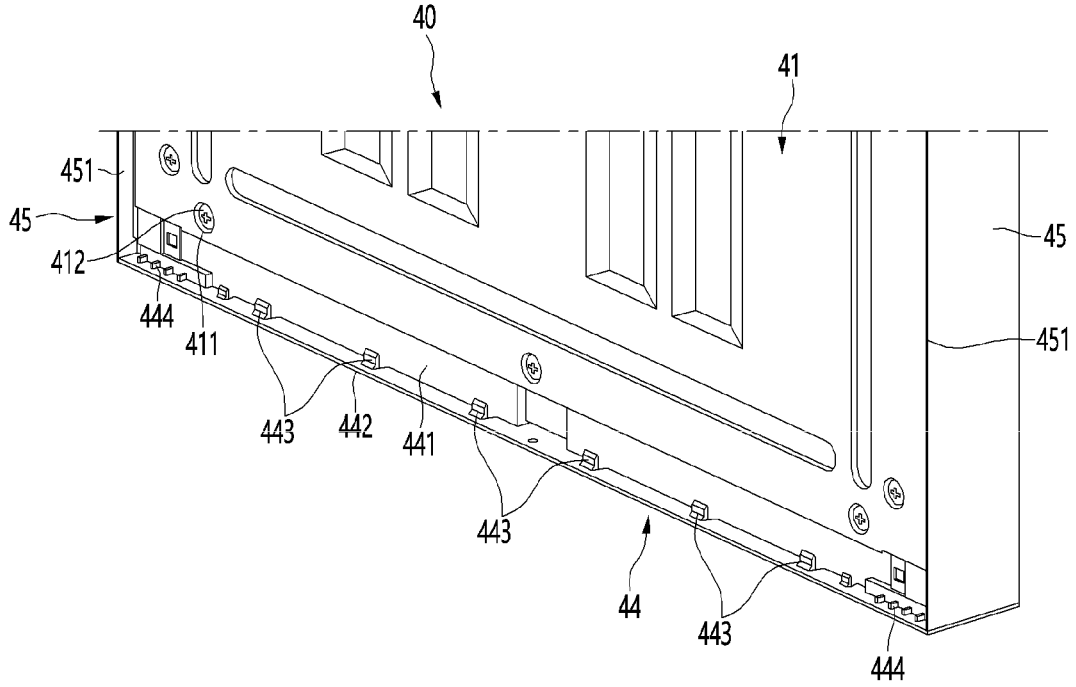
FIG. 13 is a partial perspective view showing a lower structure of the door body.
Figure 14:
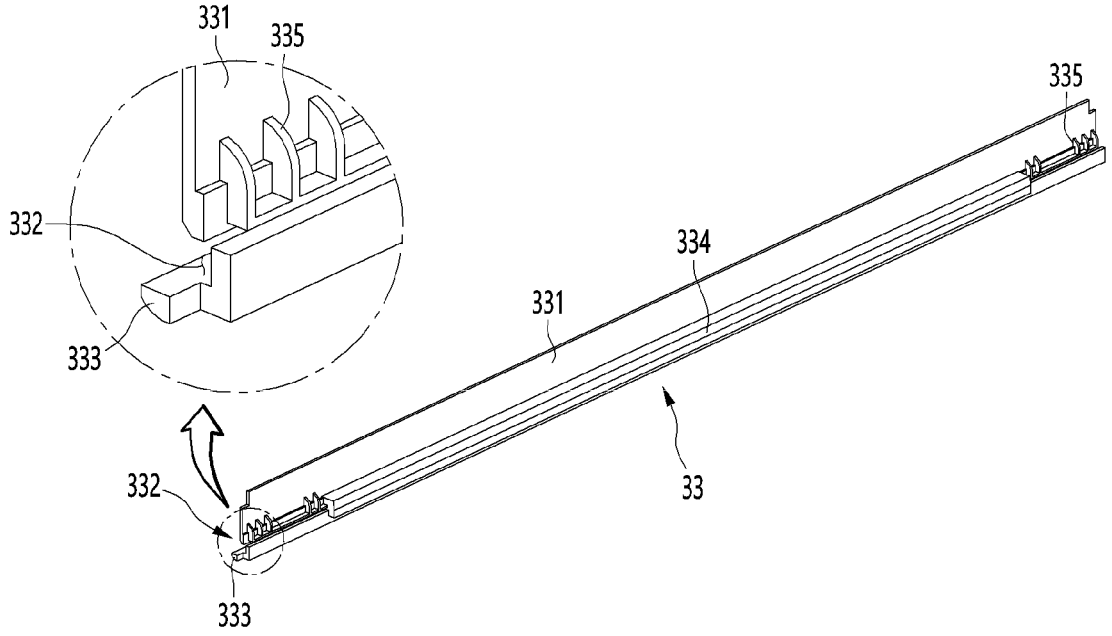
FIG. 14 is a perspective view of a lower bracket that is a component of the door panel.
Figure 15:
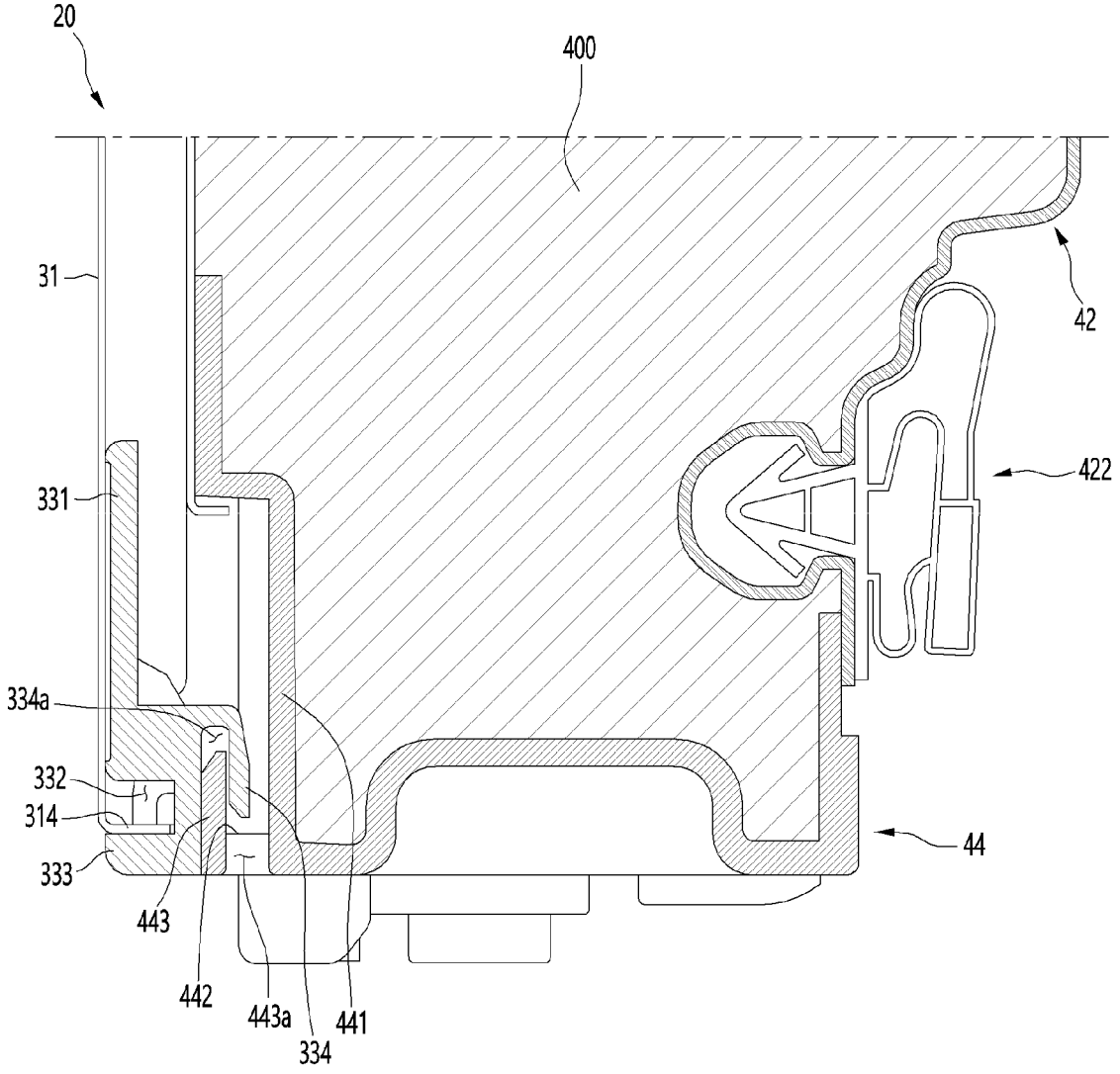
FIG. 15 is a cross-sectional view taken along XV-XV' of FIG. 1.

FIG. 13 is a partial perspective view showing a lower structure of the door body. FIG. 14 is a perspective view of a lower bracket that is a component of the door panel. FIG. 15 is a cross-sectional view taken along XV-XV' of FIG. 1.

As shown in the drawings, the lower cap deco 44 may be disposed at a lower end of the door body 40 and may define a lower appearance of the door 20 and the door body 40.

In the state in which the lower cap deco 44 is mounted on the door body 40, a lower front part 441 may be exposed to define a lower end of the front surface of the door body 40.

A lower end support part 442 protruding forward may be formed on the lower surface of the lower cap deco 44. The lower end support part 442 may protrude forward at the lower end of the lower front part 441 and may protrude at a height corresponding to a side support part 451. Both ends of the lower end support part 442 may be in contact with the lower end of the side support part 451 and may have a height corresponding to the front surface of the panel 31.

The lower end support part 442 may support the panel 31 from the below. A catch protrusion 443 protruding upward may be formed on the lower end support part 442. The plurality of catch protrusions 443 may be formed and may protrude along the lower end support part 442 at regular intervals. The catch protrusion 443 may be spaced apart from the lower front part 441. A hole 443*a* may be formed between the catch protrusion 443 and the lower front part 441, and when the lower cap deco 44 is molded, a mold core may enter and exist through the hole 443*a* to mold the catch protrusion 443.

Reinforcing ribs 444 may be further formed at right and left sides of the lower cap deco 44. The reinforcing ribs 444 may be formed between the lower end of the lower front part 441 and the upper surface of the lower end support part 442 and may connect the lower front part 441 and the lower end support part 442 to each other. The plurality of reinforcing ribs 444 may be formed and may be arranged not to interfere with each other when the door panel 30 is mounted.

The lower bracket 33 may be formed of a plastic material, and may have a length corresponding to the right and left widths of the panel 31. The lower bracket 33 may be formed to have a width set in a vertical direction.

The lower bracket 33 may be provided at the lower end of the door panel 30 and may be coupled to the lower cap deco 44 to restrain the lower end of the door panel 30. The lower bracket 33 may be coupled to a lower end of the rear surface of the panel 31, and the door panel 30 may be mounted on the lower cap deco 44, and simultaneously, may define a lower appearance of the door panel 30 and to support the lower end of the panel 31.

In detail, the lower bracket 33 may include a lower coupling part 331, a lower support part 333, and the lower mounting part 334.

The lower coupling part 331 may be formed in a planar shape and may be in contact with the rear surface of the panel 31. The lower coupling part 331 may include an adhesive member such as adhesives or a double-sided tape to be mounted in close contact with the rear surface of the panel 31. A pattern or groove structure for facilitating adhesion may be further formed on the lower coupling part 331.

A lower accommodating groove 332 may be formed below the lower coupling part 331. The lower accommodating groove 332 may be formed in a lower portion of a front surface of the lower coupling part 331. The lower accommodating groove 332 may extend from one end of the lower bracket 33 to the other end, and may be recessed to allow the lower bending part 314 of the panel 31 to be inserted. Accordingly, in the panel 31, the lower bending part 314 may be inserted into the lower accommodating groove 332, and simultaneously, the front surface of the lower coupling part 331 may be bonded to the rear surface of the panel 31. The lower bracket 33 may be assembled with the lower cap deco 44 in a state of being coupled to the panel 31.

The lower support part 333 may be formed at a lower end of the lower bracket 33, and may protrude forward from the lower end of the lower accommodating groove 332. Thus, a lower support part 442 may support the lower end of the lower bending part 314 and may be in contact with the lower end of the panel 31. In this case, the lower bracket 33 may maintain the state in which the lower bending part 314 and the lower support part 333 are in close contact with each other in the state in which the lower coupling part 331 is adhered to the panel 31, and may prevent an interval between the panel 31 and the lower support part 333 from being widened when the door panel 30 is viewed from the front.

The lower support part 333 may protrude to a position corresponding to the panel front part 311 of the panel 31, and thus the lower support part 333 may define a lower appearance of the door panel 30 while supporting the lower end of the panel 31. The lower support part 333 may support the lower end of the panel 31 to restrain a lower flow of the panel 31 and to simultaneously protect the lower end of the panel 31 from being damaged by impact.

The lower support part 333 may be formed to have a thinner thickness as protruding forward, and may be inclined or rounded to minimize exposure of the lower support part 333 when viewed from the front.

The lower mounting part 334 may protrude rearward from the rear surface of the lower coupling part 331. The lower mounting part 334 may protrude at a position corresponding to the catch protrusion 443 to insert, catch, and restrain the catch protrusion 443.

The lower mounting part 334 may protrude rearward from the upper portion of the lower accommodating groove 332, and the protruding end may extend downward. The lower mounting part 334 may have an open lower surface to define a space into which the catch protrusion 443 is inserted. The lower surface of the lower mounting part 334 may be opened long in a horizontal direction, and thus all the plurality of catch protrusions 443 may be inserted into the inside of the opening, and may be caught and restrained by the lower mounting part 334.

Accordingly, when the door panel 30 is mounted on the door body 40, the catch protrusion 443 may be inserted into the lower mounting part 334 and may be caught and restrained thereby while moving the door panel 30 downward from an upper portion, and the mounting part 324 may be accommodated on the accommodation part 436 by rotating the upper end of the door panel 30. Needless to say, through an operation of moving the door panel 30 downward from the upper portion, the lower mounting part 334 and the catch protrusion 443 may be restrained, and simultaneously the mounting part 324 and the accommodation part 436 may be accommodated.

The door panel 30 may be maintained to be firmly mounted on the door body 40 by coupling the screw 48 through the mounting part 324 and the accommodation part 436. Although right and left ends of the door panel 30 do not have a separate coupling structure, when the door panel 30 is mounted at an accurate position, right and left ends of the door panel 30, that is, the side bending part 313 may be adhered to and supported by the side support part 451 of the side deco 45, and right and left flow of the door panel 30 may be prevented.

The refrigerator according to an embodiment of the present disclosure will be possible in various other embodiments in addition to the above-described embodiment. Another embodiment of the present disclosure is the same as the above-described embodiment except for the structure of the upper bracket and upper cap deco, and the same components use the same reference numerals, and detailed descriptions and illustrations thereof may be omitted.

Figure 16:
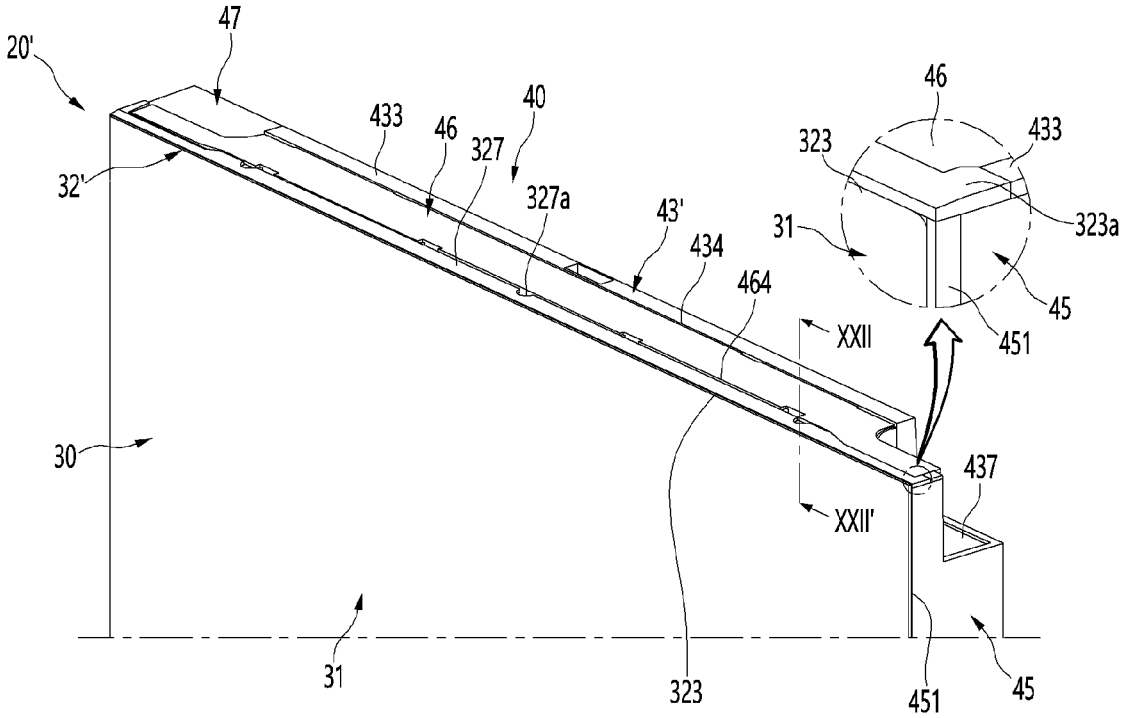
FIG. 16 is a partial perspective view showing an upper part of a refrigerator door according to another embodiment of the present disclosure.
Figure 17:
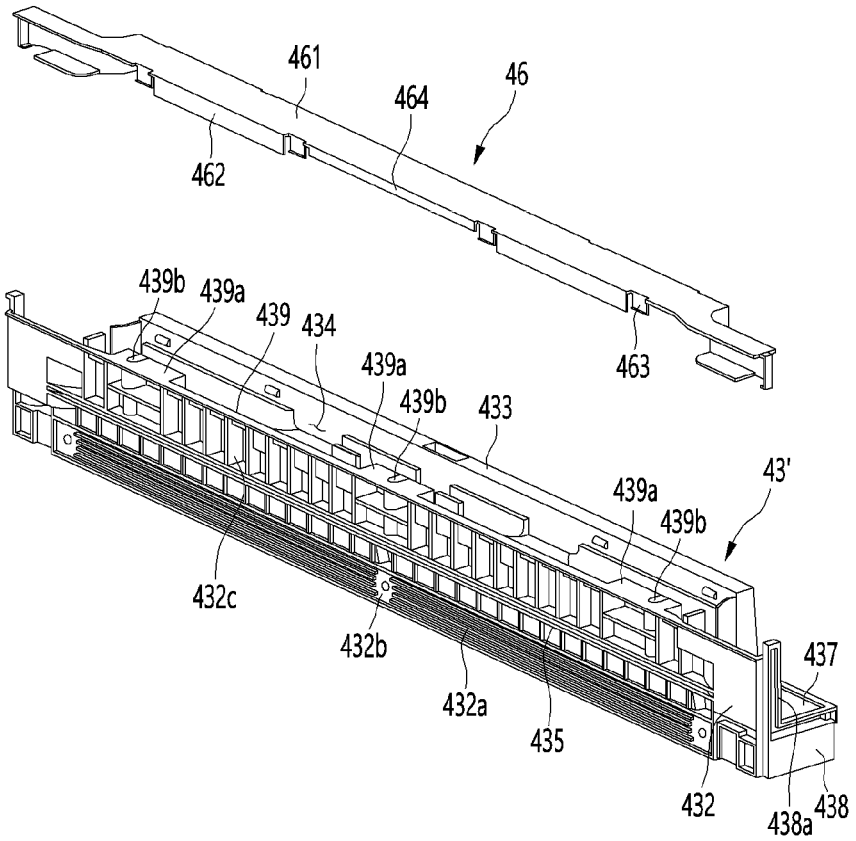
FIG. 17 is an exploded perspective view showing the state in which an upper cap deco and a deco cover of the refrigerator door are disassembled, viewed from the front.
Figure 18:
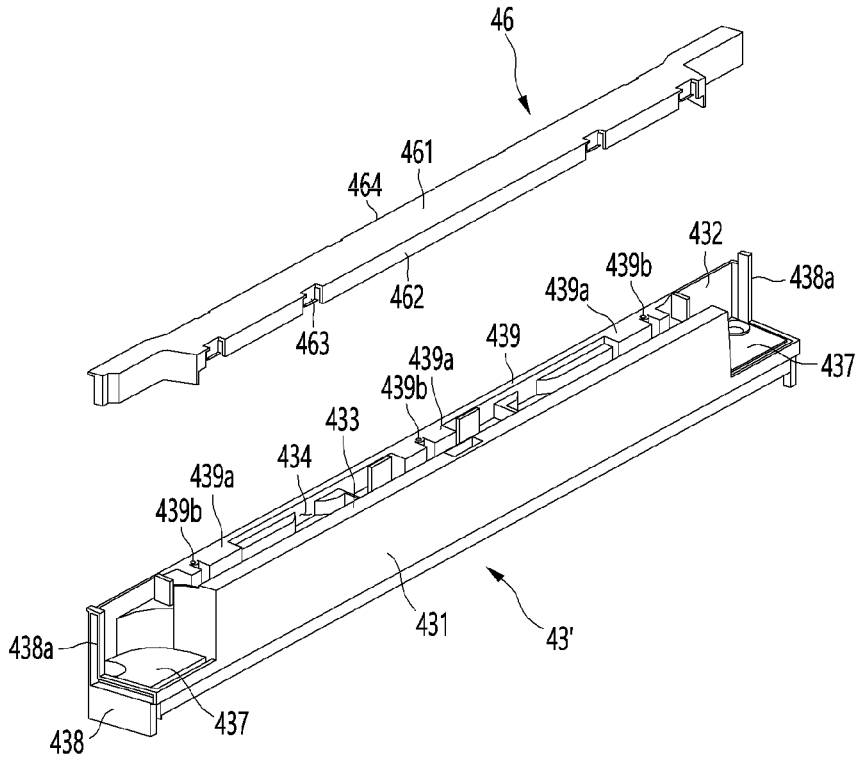
FIG. 18 is an exploded perspective view showing the state in which the upper cap deco and the deco cover are disassembled, viewed from the rear.

FIG. 16 is a partial perspective view showing an upper portion of a refrigerator door according to another embodiment of the present disclosure. FIG. 17 is an exploded perspective view showing the state in which an upper cap deco and a deco cover as components of the refrigerator door are disassembled, viewed from the front. FIG. 18 is an exploded perspective view showing the state in which the upper cap deco and the deco cover are disassembled, viewed from the rear.

As shown in the drawings, a door 20' of a refrigerator according to another embodiment of the present disclosure may be formed by coupling the door panel 30 and the door body 40 like in the above-described embodiment. However, there is only a partial difference only in the structure of an upper bracket 32' included in the door panel 30 and an upper cap deco 43' included in the door body 40, and the remaining components of the present embodiment are the same as in the above-described embodiment.

In detail, the upper cap deco 43' may be mounted on the upper end of the door body 40 to define an upper portion including the upper end of the door body 40. The upper cap deco 43' may include the rear part 431 defining a rear surface, the front part 432 defining a front surface, the upper part 433 defining an upper surface, and the side part 438 defining right and lower surfaces.

The front part 432 may be exposed forward in the state in which the door body 40 is mounted and may define an outer appearance of an upper end of the front surface of the door body 40. The front part 432 may have the cover coupling part 432*a* and the deco screw hole 432*b* that are formed in a lower end thereof and may be coupled to the upper end of the body cover 41. The cover groove 435 may be formed at the upper end of the cover coupling part 432*a*, and the cover bending part 413 bent at the upper end of the body cover 41 may be inserted into cover groove 435.

The plurality of support ribs 432*c* may be formed at the upper portion of the cover groove 435. When the door panel 30 is mounted, the support ribs 432*c* may be in contact with the rear surface of the upper bracket 32' to support the upper bracket 32' and the door panel 30 from the rear.

An accommodation part 439 on which a mounting part 328 of the door panel 30 is accommodated may be formed at the upper end of the front part 432. The accommodation part 439 may extend from left to right of the front part 432, and may be formed to support the mounting part 328 from the below.

The upper end of the front part 432, that is, the upper surface of the accommodation part 439 may be formed at a lower position than the upper surface of the upper part 433. That is, the accommodation part 439 and the upper part 433 may be stepped, and during a process in which the door panel 30 moves downward from an upper portion, the lower surface of the mounting part 328 may be accommodated on the upper surface of the accommodation part 439. In the state in which the mounting part 328 is mounted on the accommodation part 439, a shielding part 327 of the upper bracket 32' may be disposed at the same height as that of the upper part 433.

An accommodation part support surface 329*a* corresponding to a protrusion shape of the mounting part 328 may be formed on the accommodation part 439. The accommodation part support surface 329*a* may be formed at a position corresponding to a mounting part support surface 328*a* protruding from the upper bracket 32' and may be formed with a corresponding size and number. For example, the accommodation part support surface 329*a* may be formed at a horizontal center and at left and right sides of the upper cap deco 43'.

For example, viewed from the above, the accommodation part support surface 329*a* may be formed in a rectangular shape corresponding to the mounting part support surface 328*a*. The accommodation part 439 may be disposed below the upper part 433 and may be formed in parallel to the upper part 433.

An accommodation part screw hole 439*b* may be formed in the accommodation part support surface 329*a*. Thus, in the state in which the mounting part 328 is accommodated on the accommodation part support surface 329*a*, the screw 48 passing through the mounting part 328 may pass through the mounting part 328.

The upper part 433 of the upper cap deco 43' may define the upper surface of the door body 40. The deco opening 434 recessed downward may be formed on the upper part 433. The deco opening 434 may define a space with an open upper surface between the front part 432 and the rear part 431. The accommodation part support surface 329*a* may protrude into the deco opening 434.

The deco opening 434 may be shielded by the deco cover 46. The deco cover 46 may be formed in a corresponding shape to shield the deco opening 434. The deco cover 46 may be detachably to the deco opening 434 to easily couple and decouple the upper bracket 32' and the upper cap deco 43'.

The deco cover 46 may include the cover upper surface 461 for shielding the deco cover 46, and the cover edge 462 extending downward along a perimeter of the cover upper surface 461. The hook 463 may be formed on the cover edge 462.

The cover recess 464 may be formed on the front surface of the deco cover 46. The cover recess 464 may be formed in a shape corresponding to the shielding part 327 of the upper bracket 32', and may be formed to be in contact with a rear end of the shielding part 327 when the upper bracket 32' to be described below is mounted.

As shown in FIG. 16, in the state in which the deco cover 46 is mounted, the upper surface of the door body 40 may be formed by the upper part 433 of the upper cap deco 43', a cover upper surface of the deco cover 46, and the shielding part 327 and the support part 323 of the upper bracket 32'.

The hinge mounting parts 437 recessed downward may be formed at right and left sides of the upper part 433. The mounting part cover 47 may be mounted on the hinge mounting part 437 at one side, on which the hinge device is not mounted.

Side parts of the upper cap deco 43' may be formed on right and left surfaces of the upper cap deco 43'. The side part edge 438*a* coupled to the side deco 45 may be formed along a perimeter of the side part 438.

The upper bracket 32' may be disposed in front of the upper cap deco 43', and when the door panel 30 is mounted, the upper bracket 32' may be mounted on the upper cap deco 43'.

Figure 19:
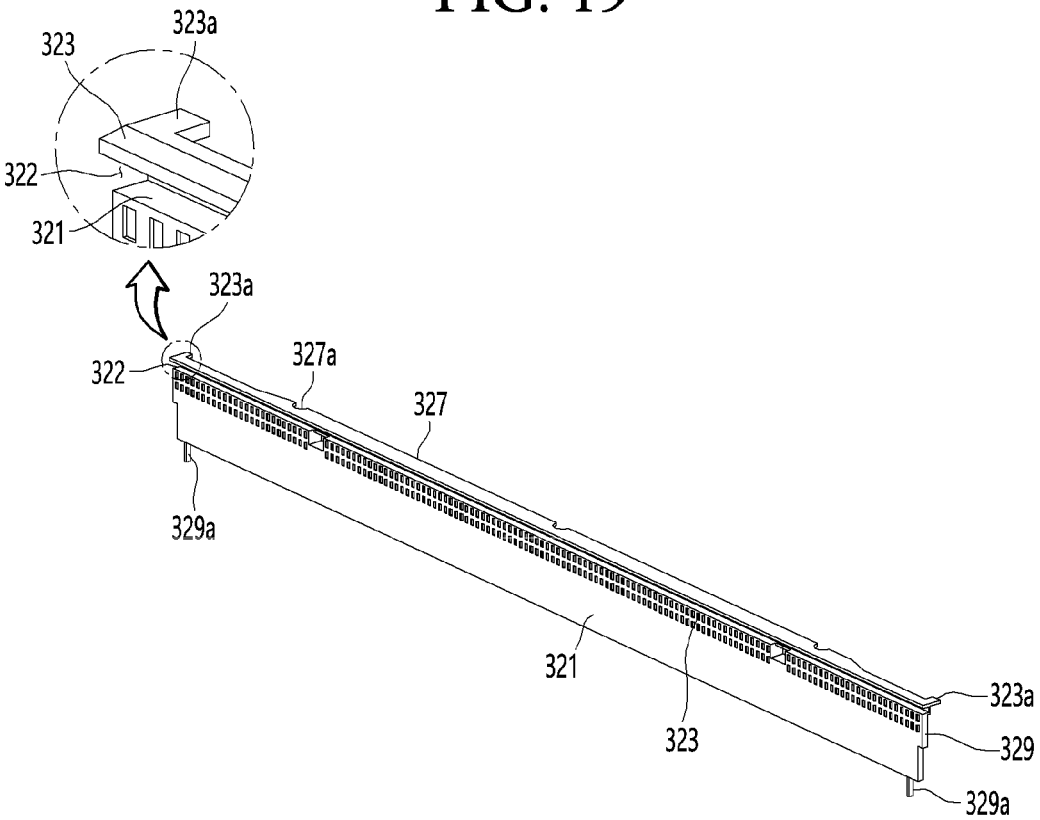
FIG. 19 is a perspective view of an upper bracket that is a component of the refrigerator door, viewed from the front.
Figure 20:
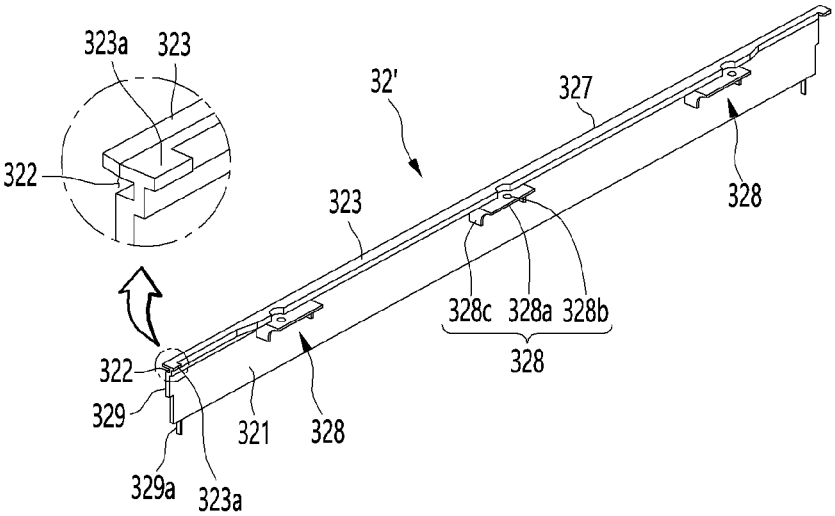
FIG. 20 is a perspective view of the upper bracket viewed from the rear.

FIG. 19 is a perspective view of an upper bracket as a component of the refrigerator door, viewed from the front. FIG. 20 is a perspective view of the upper bracket viewed from the rear.

As shown in the drawing, the upper bracket 32' may be formed of a plastic material, and may include the coupling part 321 coupled to a rear surface of the panel 31, the support part 323 formed at an upper end of a front surface of the coupling part 321, and the mounting part 328 protruding rearward on a rear surface of the coupling part 321.

In detail, the coupling part 321 may be attached to the rear surface of the panel 31 and may be formed in a plate shape having a predetermined area. A horizontal width of the coupling part 321 may be formed to correspond to a horizontal length of the panel 31.

An adhesive may be applied to a front surface of the coupling part 321 or a member for bonding such as a double-sided tape may be disposed on the front surface. Accordingly, the coupling part 321 may maintain a state of being completely adhered to the rear surface of the panel 31.

The upper accommodating groove 322 may be formed at an upper portion of the coupling part 321. The upper accommodating groove 322 may extend from one end of the upper bracket 32' to the other end, and may be recessed to allow the upper bending part 312 of the panel 31 to be inserted thereinto. Accordingly, in the panel 31, the upper bending part 312 may be inserted into the upper accommodating groove 322, and simultaneously, the front surface of the coupling part 321 may be bonded to the rear surface of the panel 31. In addition, the upper bracket 32' may be assembled with the upper cap deco 43' in the state of being coupled to the panel 31.

The support part 323 may be formed at the upper end of the upper bracket 32'. The support part 323 may be formed above the coupling part 321 and may protrude forward from the upper end of the upper accommodating groove 322. Thus, the support part 323 may support the upper end of the upper bending part 312 and may be in contact with the upper end of the panel 31. In this case, the upper bracket 32' may maintain the state in which the upper bending part 312 and the support part 323 are in close contact with each other in the state in which the coupling part 321 is adhered to the panel 31, and may prevent an interval between the panel 31 and the support part 323 from being widened when the door panel 30 is viewed from the front.

The support part 323 may protrude to a position corresponding to the panel front part 311 of the panel 31, and thus the support part 323 may define an upper appearance of the door panel 30 while supporting the upper end of the panel 31. The support part 323 may support the upper end of the panel 31 to restrain an upward flow of the panel 31 and to simultaneously protect the upper end of the panel 31 from being damaged by impact.

The support part 323 may be formed to have a thinner thickness as protruding forward, and may be inclined or rounded to minimize exposure of the support part 323 when viewed from the front.

The mounting part 328 may protrude rearward from the rear surface of the coupling part 321. The mounting part 328 may protrude at a position corresponding to the accommodation part 439 and may be inserted into and accommodated on the accommodation part 439.

In detail, the mounting part 328 may include the mounting part support surface 328*a* protruding rearward from the coupling part 321. The mounting part support surface 328*a* may be formed at a height corresponding to the accommodation part support surface 329*a*, and may be formed in a shape corresponding to the accommodation part support surface 329*a*. For example, the mounting part support surface 328*a* may be formed in a rectangular shape viewed from the above. When the mounting part 328 is mounted on the accommodation part 439, the mounting part support surface 328*a* may be inserted into the inside of the accommodation part 439 and surface-contact and may be accommodated on the upper surface of the accommodation part support surface 329*a*.

A mounting part screw hole 328*b* may be formed in the mounting part support surface 328*a*. The mounting part screw hole 328*b* may be formed on the same extension line as the accommodation part screw hole 439*b* and may be formed to allow the screw 48 to be coupled thereto in the state in which the mounting part 328 is mounted on the accommodation part 439.

A reinforcing rib 328*c* may be formed between the lower surface of the mounting part support surface 328*a* and the rear surface of the coupling part 321. The reinforcing rib 328*c* may extend to cross each of the coupling part 321 and the mounting part 328 and may connect the coupling part 321 and the mounting part 328 to each other.

The shielding part 327 protruding rearward may be further formed on the upper end of the coupling part 321, that is, the upper end of the upper bracket 32'. The shielding part 327 may extend to cover all the plurality of mounting parts 328 disposed at a lower portion from the above.

A shielding part groove 327*a* may be formed on the shielding part 327. The shielding part groove 327*a* may be formed on the same extension line as the mounting part screw hole 328*b*. Accordingly, the screw 48 may be coupled to or decoupled from the mounting part screw hole 328*b* by inserting a tool such as a driver into the mounting part screw hole 328*b* through the shielding part groove 327*a*, and a coupling state of the screw 48 may be checked through the shielding part groove 327*a*.

A rear end of the mounting part 328 may be formed in a shape corresponding to the shielding part groove 327*a* formed on an upper end of a front surface of the shielding part 327. Accordingly, in the state in which the mounting part 328 is accommodated on the accommodation part 439, the shielding part 327 may be in contact with the deco cover 46. That is, in the state in which the door panel 30 is mounted, an upper surface of the door 20' may be formed by upper surfaces of the shielding part 327 and the deco cover 46, and the upper part 433.

The bracket sides 329 for coupling with the side deco 45 may be formed at right and left ends of the upper bracket 32'. Side protrusions 323*a* may be formed at right and left ends of the upper end of the upper bracket 32'. The side protrusions 323*a* may be in contact with the upper end of the side deco 45 and upper ends of right and left surfaces of the upper cap deco 43' to define a portion of the upper surface of the door 20'. The guide protrusion 329*a* extending downward may be formed at right and left sides of a lower end of the upper bracket 32', that is, right and left ends of the lower end of the coupling part 321.

Hereinafter, a coupling structure of the upper bracket 32' and the upper cap deco 43' as configured above will be described in more detail with reference to the drawings.

Figure 21:
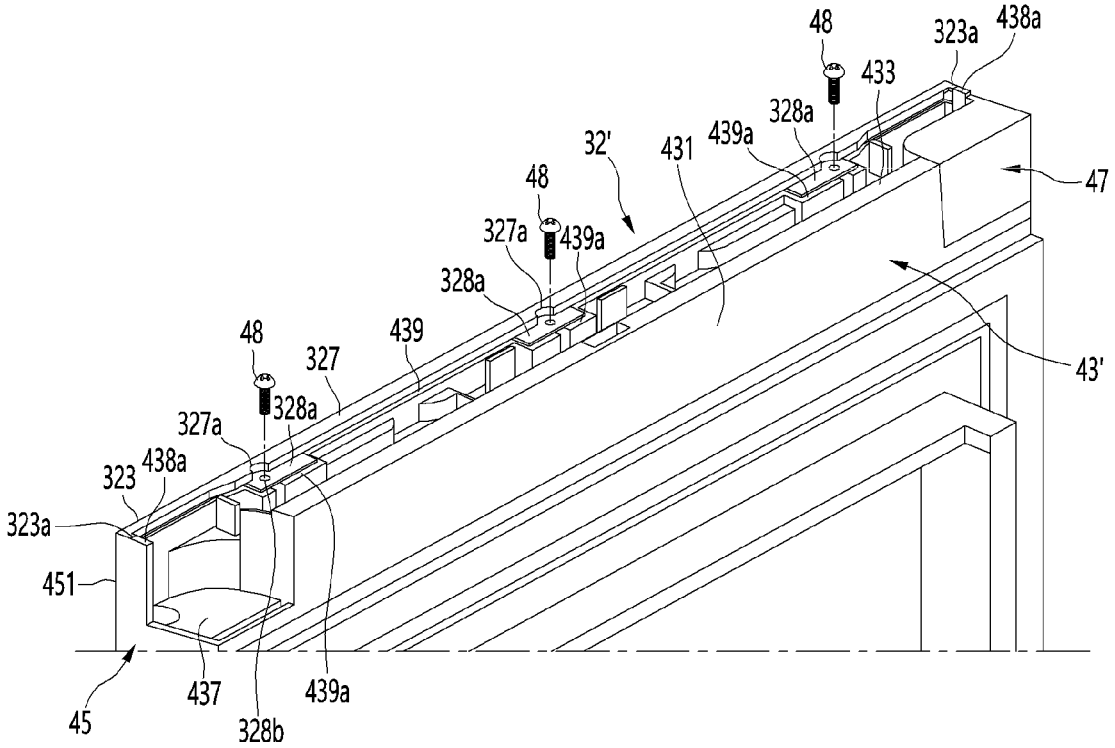
FIG. 21 is a partial perspective view showing a coupling structure of the upper bracket and the upper cap deco in the state in which the door panel is mounted on a door body.
Figure 22:
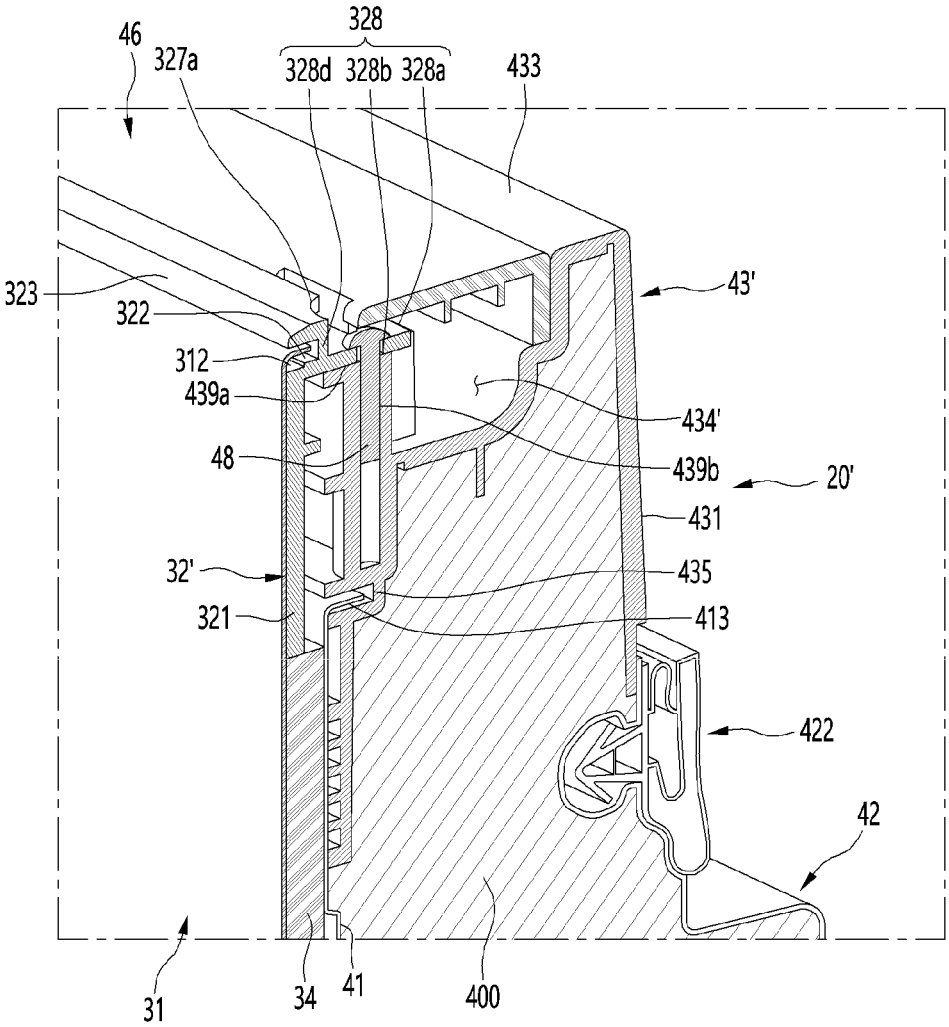
FIG. 22 is a perspective view taken along XXII-XXII' of FIG. 16.

FIG. 21 is a partial perspective view showing a coupling structure of the upper bracket and the upper cap deco in the state in which the door panel is mounted on a door body. FIG. 22 is a perspective view taken along XXII-XXII' of FIG. 16.

As shown in the drawings, when the door panel 30 is mounted on the door body 40, the mounting part support surface 328*a* may be mounted on an upper surface of the accommodation part support surface 329*a*. The mounting part support surface 328*a* may be superimposed on the upper surface of the accommodation part support surface 329*a*, and both side surfaces of the upper bracket 32' may be disposed inside the side deco 45 to be disposed at an accurate position.

When the mounting part support surface 328*a* is accommodated on the accommodation part support surface 329*a*, the mounting part screw hole 328*b* and the accommodation part screw hole 439*b* may be aligned, and the screw 48 may be coupled through the mounting part screw hole 328*b* and the accommodation part screw hole 439*b*. The door panel 30 may be firmly fixed to the door body 40 by coupling the screw 48.

After the door panel 30 is completely mounted by coupling the screw 48, the deco cover 46 may be mounted on the open upper surface of the deco opening 434 to shield the deco opening 434. In this case, the accommodation part 439 inside the deco opening 434 may be shielded not to be exposed to the outside by the deco cover 46.

In order to mount the door panel 30 on the door body 40, when the mounting part 328 is accommodated on the accommodation part 439, the shielding part 327 may define a portion of an upper surface of the door 20'. The shielding part 327 may be disposed on the same plan together with the upper part 433 and the upper surface of the deco cover 46 to define an upper appearance of the door 20'.

Even if compressive force is applied to the front surface of the panel 31 during use in the state in which the door panel 30 is mounted, the front part of the upper cap deco 43', that is, the support ribs 432*c* may be maintained to support the coupling part 321 of the upper bracket 32', thereby originally preventing the door panel 30 from being pressed or moved rearward and being deformed.

The upper bracket 32' is mounted in the state of being already coupled to the panel 31, and thus the upper end of the panel 31 and the support part 323 may be maintained to be in close contact with each other. Thus, while the door 20' is used, it may be possible to prevent an interval between the upper end of the panel 31 and the support part 323 from being widened.

The refrigerator according to an embodiment of the present disclosure will be possible in various other embodiments in addition to the above-described embodiment. Another embodiment of the present disclosure is the same as the above-described embodiment except for the structure of the panel and the panel bracket, and the same components use the same reference numerals, and detailed descriptions and illustrations thereof may be omitted.

Figure 23:
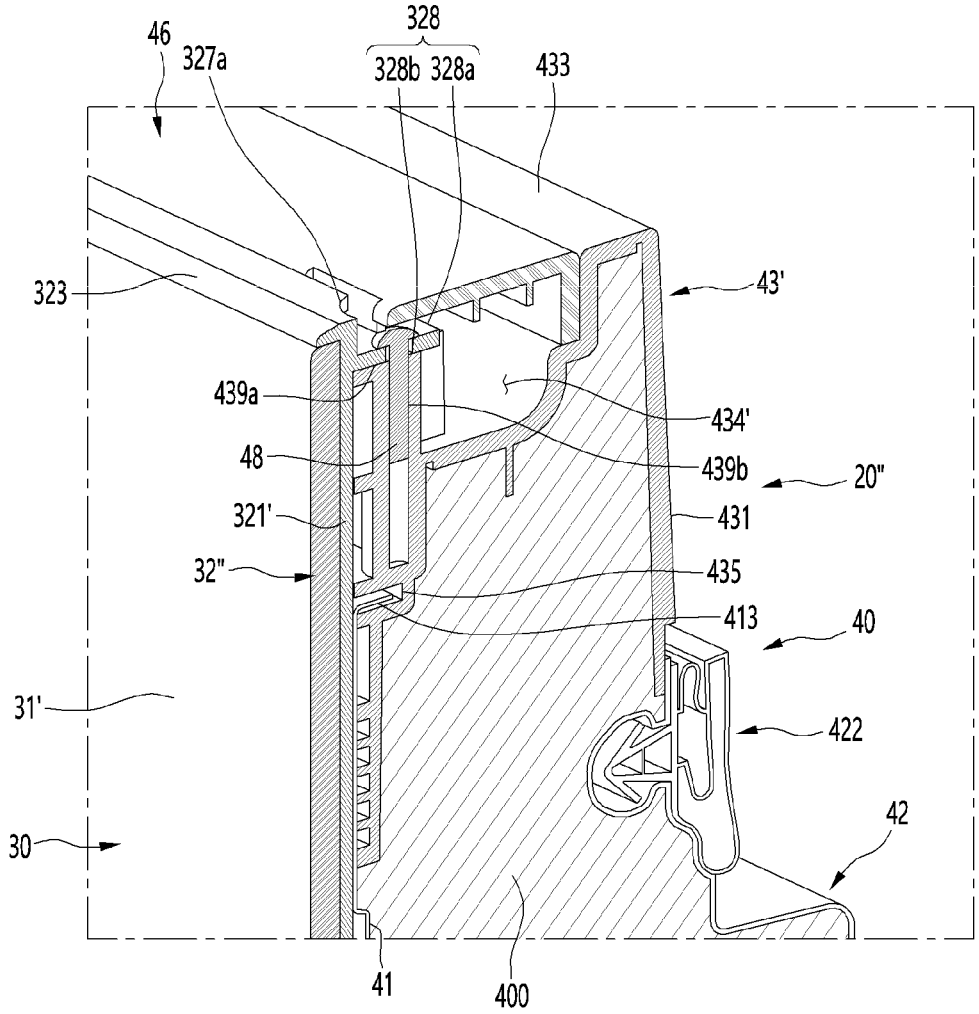
FIG. 23 is a partial exploded perspective view of showing a coupling structure of a door panel and a door body according to another embodiment of the present disclosure.

FIG. 23 is a partial exploded perspective view of showing a coupling structure of a door panel and a door body according to another embodiment of the present disclosure.

As shown in the drawings, a door 20" of the refrigerator according to another embodiment of the present disclosure may differ from the above-described embodiment only in a part of a door panel 31', that is, the structure of a panel 31' and the panel bracket and the remaining structure between the embodiments may be completely the same.

In detail, the door panel 31' may include the panel 31' formed of a glass material, and a panel bracket attached to a bottom surface of the panel 31' and allowing the door panel 31' to be mounted on the door body 40.

The panel 31' may be formed of a tempered glass or a plastic material, and may be formed in a flat plate shape to define a front appearance of the door panel 31'. The upper and lower ends of the panel 31' may be supported by the panel bracket, and left and right ends of the panel 31' may be supported by the side deco 45.

The panel bracket may include an upper bracket 32" disposed at an upper end of the panel 31' and the lower bracket 33.

The upper bracket 32" may be attached to an upper end of the rear surface of the panel 31', and may be accommodated on and fixed to an accommodation part of the upper cap deco 43'. The upper bracket 32" may include a coupling part 321', the support part 323, and the mounting part 328. In this case, the support part 323 and the mounting part 328 may be the same as the above-described embodiment.

In detail, the coupling part 321' may be attached to the rear surface of the panel 31' and may be formed in a plate shape having a predetermined area. A horizontal width of the coupling part 321' may be formed to correspond to a horizontal length of the panel 31'.

An adhesive may be applied to a front surface of the coupling part 321' or a member for bonding such as a double-sided tape may be disposed on the front surface. Accordingly, the coupling part 321' may maintain a state of being completely adhered to the rear surface of the panel 31'. Accordingly, when the door panel 31' is mounted on the door body 40, the upper bracket 32" may be mounted in the state in which the door panel 31' is already coupled.

The support part 323 may be formed at an upper end of the upper bracket 32", that is, an upper end of the coupling part 321'. The support part 323 may protrude forward from the upper end of the coupling part 321'. The support part 323 may protrude in a direction perpendicular to the front surface of the coupling part 321', and thus may support the upper end of the panel 31'.

In this case, the lower surface of the support part 323 and the upper end of the panel 31' may be maintained to be in close contact with each other, and when the door panel 31' is viewed from the above, an interval between the panel 31' and the support part 323 may not be widened. Thus, in the state in which the upper bracket 32" is mounted, the interval between the panel 31' and the support part 323 may not be widened and close contact therebetween may be maintained.

The support part 323 may protrude to a position corresponding to a front plate of the panel 31', and thus the support part 323 may define an upper appearance of the door panel 31' while supporting the upper end of the panel 31'. The The support part 323 may support the upper end of the panel 31' to restrain an upward flow of the panel 31' and to simultaneously protect the upper end of the panel 31' from being damaged by impact.

The support part 323 may be formed to have a thinner thickness as protruding forward, and may be inclined or rounded to minimize exposure of the support part 323 when viewed from the front.

The mounting part 328 may protrude rearward from the rear surface of the coupling part 321'. The mounting part 328 may protrude at a position corresponding to the accommodation part 439 and may be inserted into and accommodated on the accommodation part 439. In this case, the mounting part support surface 328*a* of the mounting part 328 may be accommodated on an upper surface of an accommodation surface support part 439*a*.

The mounting part screw hole 328*b* may be formed in the mounting part support surface 328*a*. The mounting part screw hole 328*b* may be formed on the same extension line as the accommodation part screw hole 439*b* and may be formed to allow the screw 48 to be coupled thereto in the state in which the mounting part 328 is mounted on the accommodation part 439.

The mounting part 328 may be mounted on the accommodation part 439, and the door panel 31' may be firmly fixed to the door body 40 by coupling the screw 48. In this state, the deco cover 46 may be mounted on the upper surface of the upper cap deco 43' to shield the deco opening 434.

Thus, the upper surface of the door 20" may be formed by the support part 323, the deco cover 46, and the upper part 433.

The embodiment of the present disclosure will be possible in various other embodiments in addition to the above-described embodiment. According to other embodiments of the present disclosure, a door panel or an outer panel defining an exterior may be applied to home appliances other than a refrigerator to change the exterior color of the household appliance. Another embodiment of the present disclosure may differ only in the size and shape of the door panel or outer panel and an object of application, but the structure of the door panel or outer panel is the same, and the same reference numerals are used for the same configuration, and the detailed description thereof is to be omitted.

In embodiments to be described below, the configuration of the door panel is the same as in the above-described embodiment, and the specific configuration may be understood with reference to the description and drawings of the above-described embodiment, and the detailed description is omitted to avoid repetition.

Hereinafter, other embodiments of the present disclosure will be described with reference to the drawings.

Figure 24:
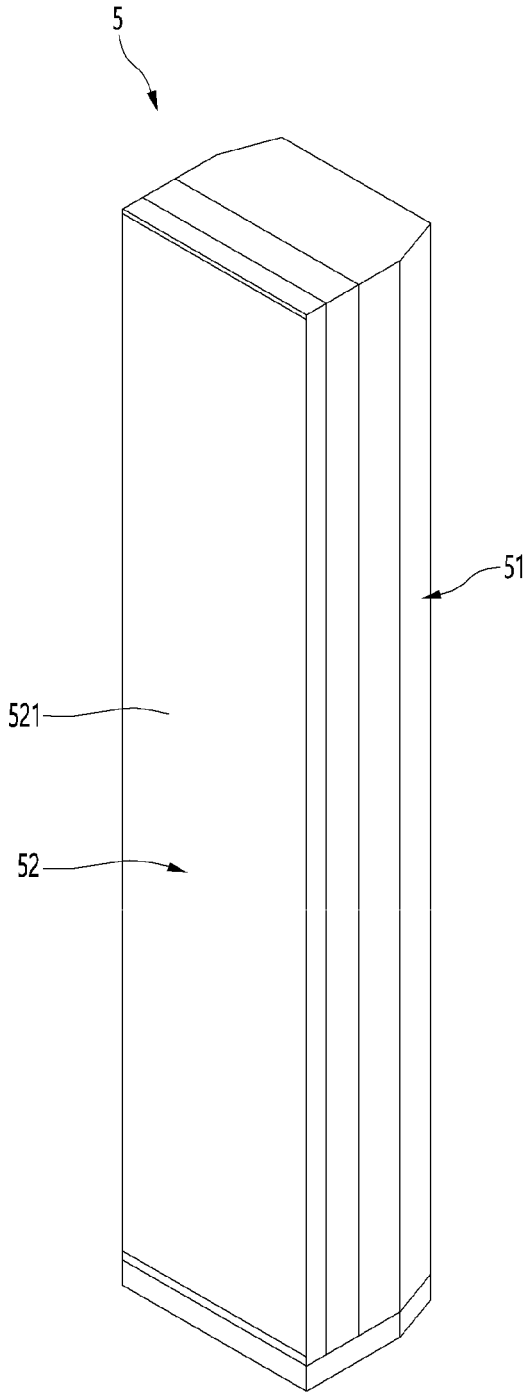
FIG. 24 is a perspective view of an indoor unit of an air conditioner according to another embodiment of the present disclosure.
Figure 25:
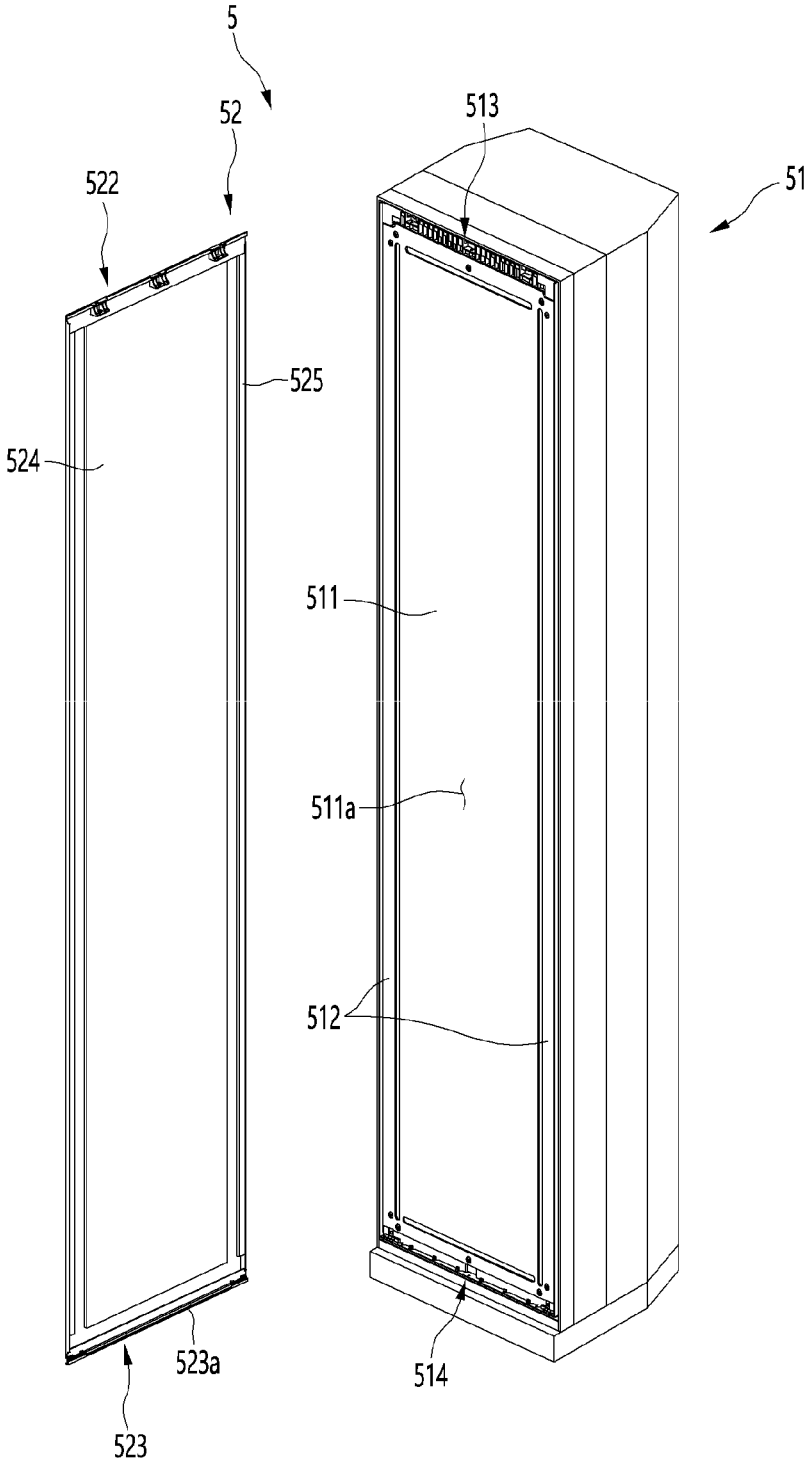
FIG. 25 is an exploded perspective view showing the case in which an outer panel of the indoor unit is disassembled.

FIG. 24 is a perspective view of an indoor unit of an air conditioner according to another embodiment of the present disclosure. FIG. 25 is an exploded perspective view showing the case in which a door panel of the indoor unit is disassembled.

As shown in the drawings, an indoor unit 5 of the air conditioner according to another embodiment of the present disclosure may include a case 51 defining an outer appearance, and an outer panel 52 mounted on a front surface of the case 51 and defining a front appearance of the indoor unit 5.

Although not shown in detail, in general, the case 51 may accommodate components constituting a refrigeration cycle including a heat exchanger and a blower fan, and an inlet for sucking indoor air and an outlet for discharging heat-exchanged air into an indoor space may be formed at one side of the case 51.

A side deco defining a side surface may be provided at right and left sides of a case front surface 511, and an upper cap deco 513 and a lower cap deco 514 may be provided at upper and lower ends of the case front surface 511, respectively.

The upper cap deco 513 and the lower cap deco 514 may have the same structure as the upper cap deco 43 and the lower cap deco 44 of the above-described embodiment, only different in size and arrangement. Accordingly, an accommodation part for coupling with an upper bracket 522 may be formed on the upper cap deco 513, and a catch protrusion for coupling with the lower bracket 523 may be formed on the lower cap deco 514.

A side deco 512 may protrude forward from the case front surface 511 to define a panel accommodating space 511*a* in which a panel assembly 52 is accommodated. The outer panel 52 may define a front appearance of the indoor unit 5 and may be disposed in the panel accommodating space 511*a*.

The lower end of the outer panel 52 may be caught and restrained by the lower cap deco 514, and the upper end of the outer panel 52 may be coupled to the upper cap deco 513 to fixedly mount the outer panel 52 on the front surface of the case 51.

The outer panel 52 may have the same structure as the door panel 30 of the above-described embodiment, only different in size as a whole. The outer panel 52 may include a panel 521 defining a front surface, the upper bracket 522 mounted at an upper end of a rear surface of the panel 521, and the lower bracket 523 mounted at a lower end of the rear surface of the panel 521.

A mounting part 522*a* accommodated on an accommodation part of the upper cap deco 513 may be formed on the upper bracket 522. A lower mounting part 523*a* coupled to the catch protrusion 514*a* of the lower cap deco 514 may be formed on the lower bracket 523.

A support part for supporting the upper end of the panel 521 may be formed on the upper bracket 522, and a lower support part for supporting the lower end of the panel 521 may be formed on the lower bracket 523 to support the panel 521 and to define an outer appearance of the upper and lower ends of the outer panel 52.

Accordingly, in the state in which the outer panel 52 is mounted, the outer panel 52 may define a neat front appearance of the indoor unit 5, and when the outer panel 52 is mounted, it may be possible to easily align and firmly mount the outer panel 52. In addition, the outer panel 52 may be simply separated and mounted to easily change or replace an outer appearance of the indoor unit 5.

A buffer member 524 in contact with the case front surface 511 may be provided on a rear surface of the panel 521. A magnet 525 to be magnetically attached to the case front surface 511 formed of steel may be provided on both right and left sides of the rear surface of the panel 521.

Figure 26:
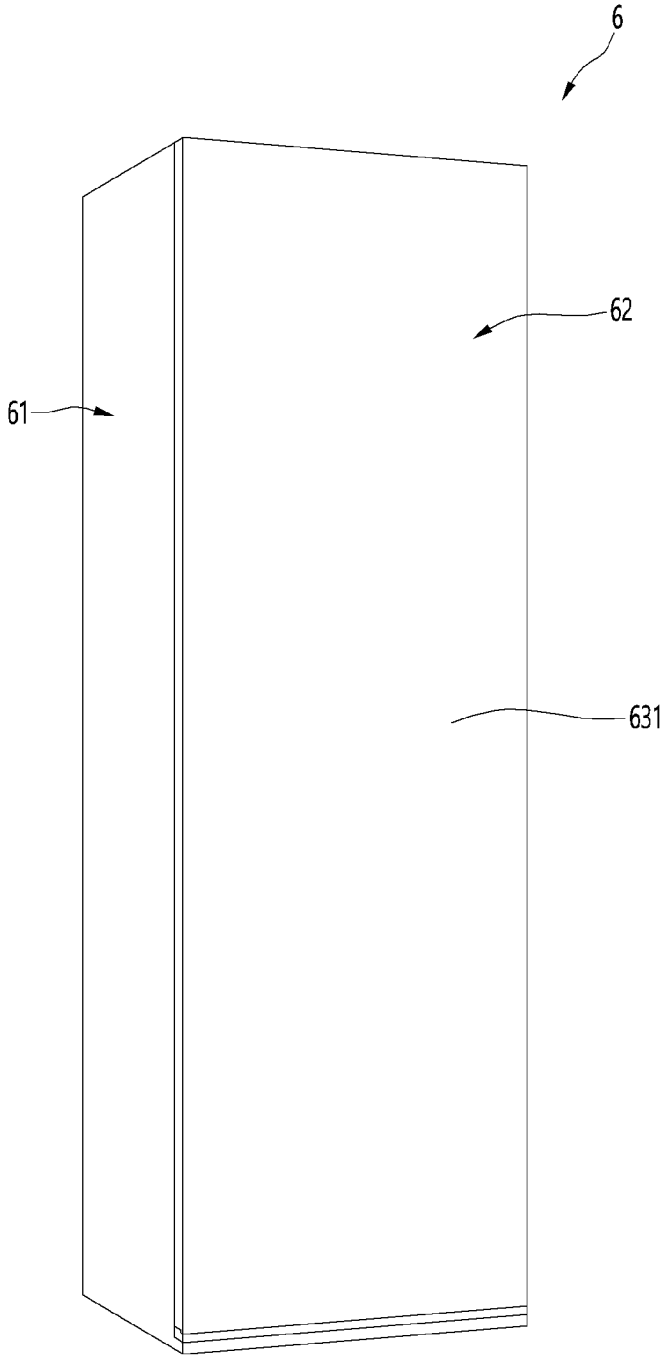
FIG. 26 is a perspective view of a laundry manager according to another embodiment of the present disclosure.
Figure 27:
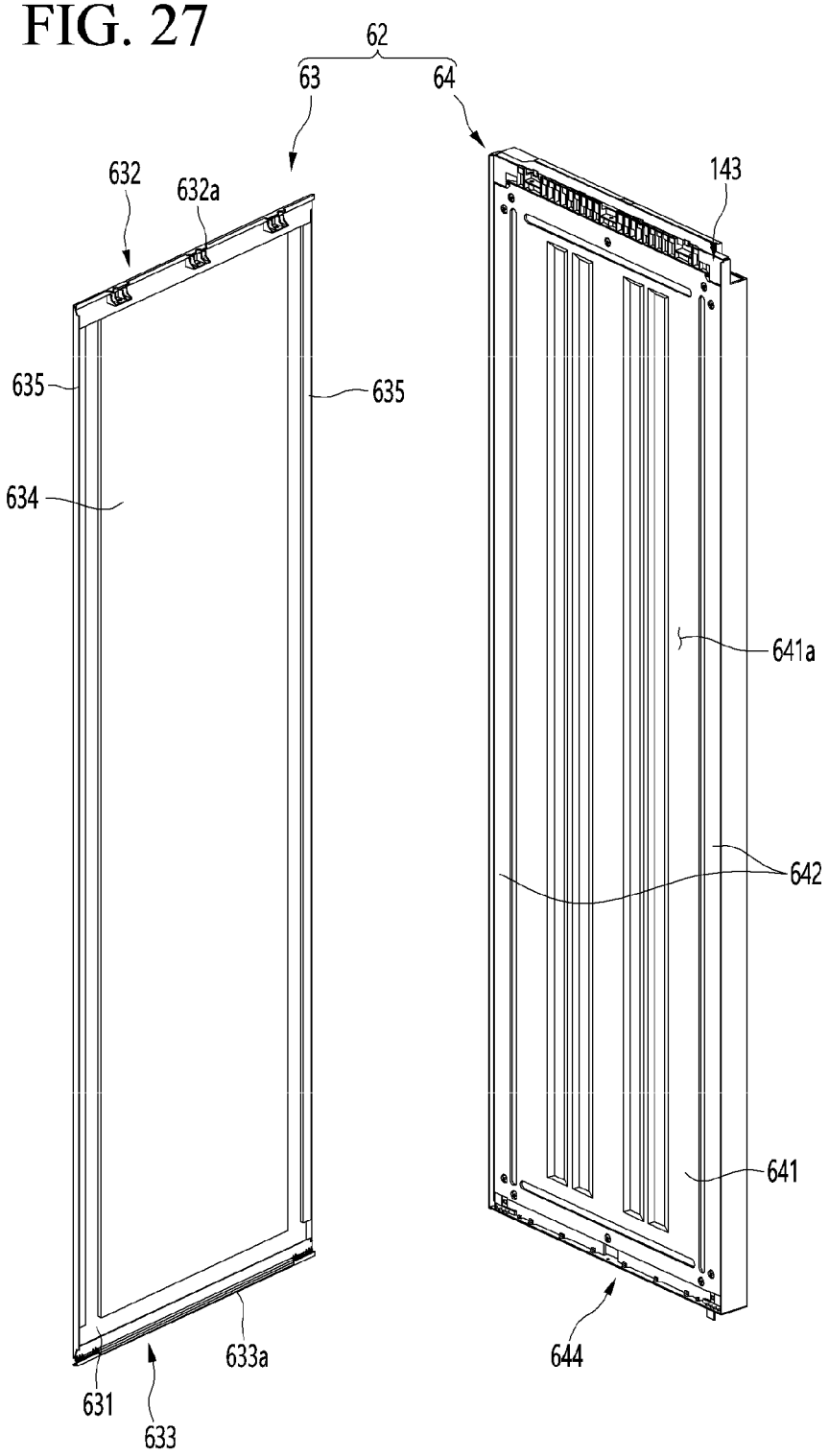
FIG. 27 is an exploded perspective view of a door of the laundry manager.

FIG. 26 is a perspective view of a laundry manager according to another embodiment of the present disclosure. FIG. 27 is an exploded perspective view of a door of the laundry manager.

As shown in the drawing, a laundry manager 6 according to another embodiment of the present disclosure may have an outer appearance defined by a case 61 defining a laundry accommodating space and a door 62 for opening and closing an open front surface of the case 61.

In general, the case 61 may have a laundry accommodating space in which laundry is accommodated, and a heat pump, a water tank, a steam generator, and an air circulation fan may be provided inside a machine room formed separately from the laundry accommodating space.

An outlet for discharging steam generated by the steam generator and dry air heated by the heat pump may be formed inside the laundry accommodating space, and an inlet for sucking air of the laundry accommodating space may be formed therein.

The door 62 may be rotatably mounted on the case 61, and may be configured to define a front appearance of the laundry manager 6 in a state in which the door 62 is closed. In addition, the door 62 may include a door body 63 for opening and closing the laundry accommodating space, and a door panel 63 mounted on the door body 64 to define a front surface of the door 62.

A body plate 641 may be provided on a front surface of the door body 64 to define a front surface of the door body 64. A side deco 642 extending up and down may be provided along both right and left ends of the door body 64. An upper surface of the door body 64 may be formed by an upper cap deco 643 for connecting upper ends of the side deco 642 at both right and left sides, and a lower surface of the door body 64 may be formed by a lower cap deco 644 for connecting lower ends of the side deco 642 at both right and left sides.

The upper cap deco 643 and the lower cap deco 644 may have the same structure as the upper cap deco 43 and the lower cap deco 44 of the above-described embodiment, only different in size and arrangement. Thus, an accommodation part for coupling with the upper bracket 632 may be formed on the upper cap deco 643, and a catch protrusion for coupling with the lower bracket 633 may be formed on the lower cap deco 644.

The side deco 642 may protrude compared with the front surface of the body plate 641, and a panel accommodating space 641*a* in which the door panel 63 is accommodated may be formed in front of the body plate 641. The door panel 63 may define a front appearance of the laundry manager 6 and may be disposed in the panel accommodating space 641*a*.

A lower end of the door panel 63 may be caught and restrained by the lower cap deco 644, and an upper end of the door panel 63 may be coupled to the upper cap deco 643 to fixedly mount the door panel 63 on the front surface of the case 61.

The door panel 63 may have the same structure as the door panel 30 of the above-described embodiment, only different in size as a whole. The door panel 63 may include a panel 631 defining a front surface, the upper bracket 632 mounted at an upper end of a rear surface of the panel 631, and the lower bracket 633 mounted at a lower end of the rear surface of the panel 631.

A mounting part 632*a* accommodated on the accommodation part of the upper cap deco 643 may be formed on the upper bracket 632. A lower mounting part 633*a* coupling with a catch protrusion of the lower cap deco 644 may be formed on the lower bracket 633.

A support part for supporting the upper end of the panel 631 may be formed on the upper bracket 632, and a lower support part for supporting the lower end of the panel 631 may be formed on the lower bracket 633 to support the panel 631 and to define an outer appearance of the upper and lower ends of the door panel 63.

Accordingly, in the state in which the door panel 63 is mounted, the door panel 63 may define a neat front appearance of the laundry manager 6, and when the door panel 63 is mounted, it may be possible to easily align and firmly mount the door panel 63. In addition, the door panel 63 may be simply separate and mount to easily change or replace an outer appearance of the laundry manager 6.

A buffer member 634 in contact with the body plate 641 may be provided on a rear surface of the panel 631. A magnet 635 to be magnetically attached to the body plate 641 formed of steel may be provided on both right and left sides of the rear surface of the panel 631.

Figure 28:
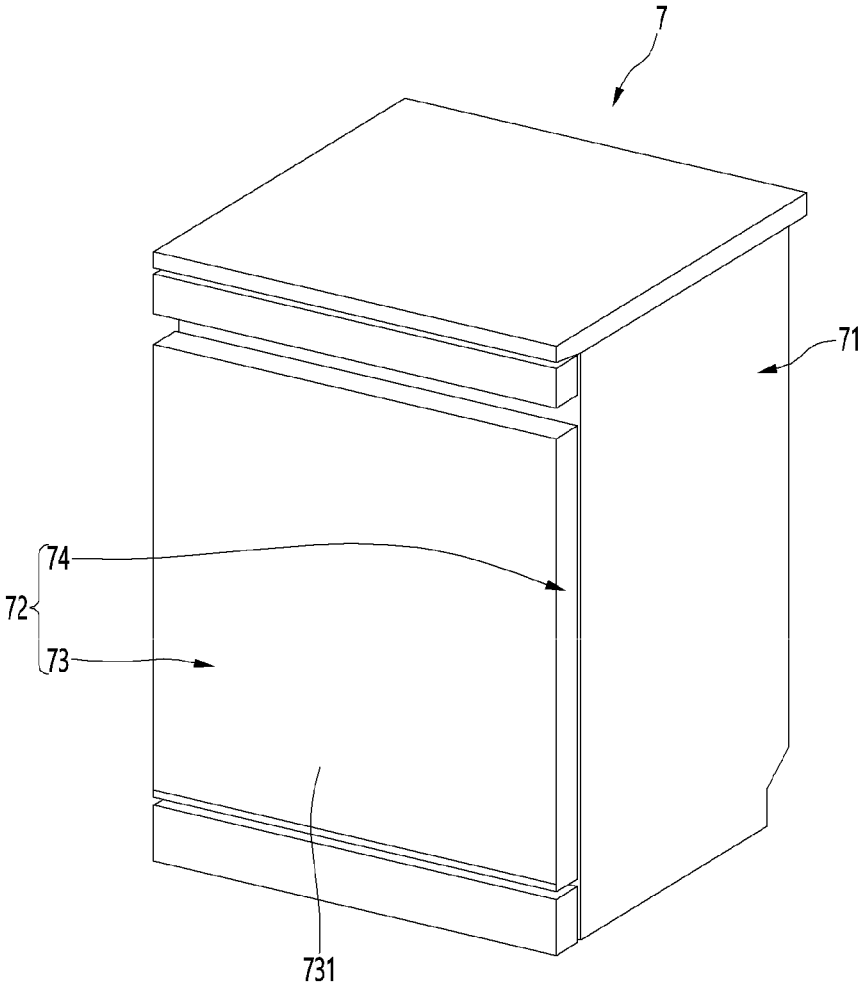
FIG. 28 is a perspective view of a dish washer according to another embodiment of the present disclosure.
Figure 29:
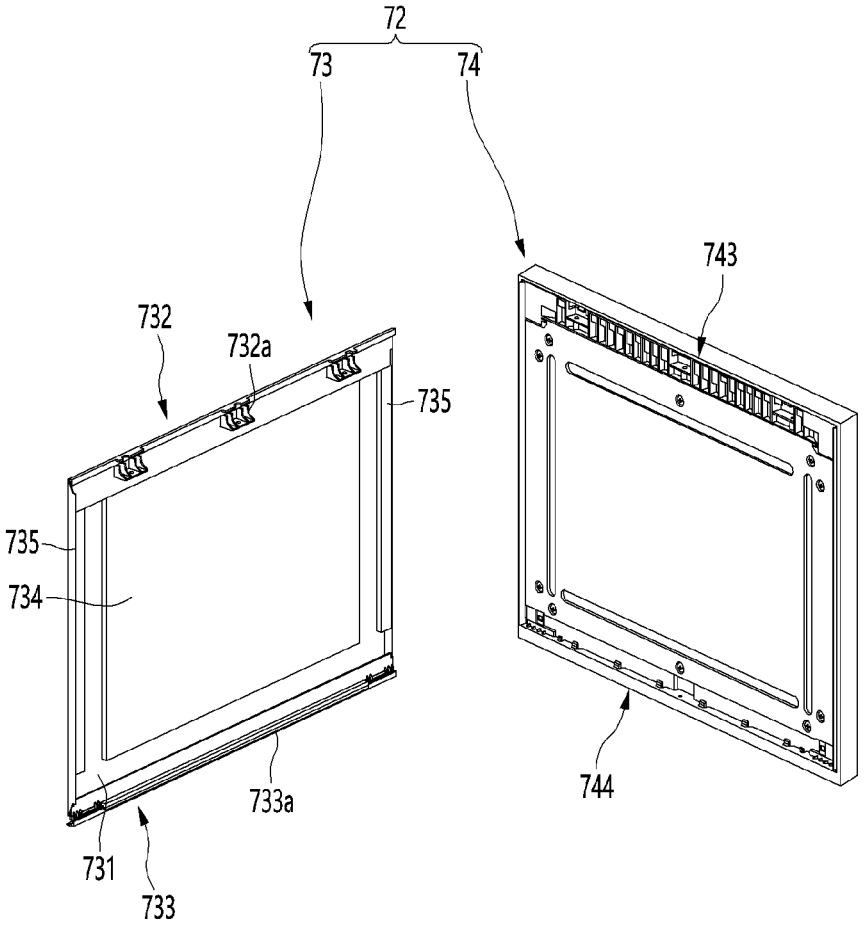
FIG. 29 is an exploded perspective view of a door of the dish washer.

FIG. 28 is a perspective view of a dish washer according to another embodiment of the present disclosure. FIG. 29 is an exploded perspective view of a door of the dish washer.

As shown in the drawings, a dish washer 7 according to another embodiment of the present disclosure may have an outer appearance defined by a case 71 defining a space in which dishes are accommodated and washed, and a door 72 for opening and closing an open front surface of the case 71.

Although not shown in detail, in general, the case 71 may have a washing space therein, a rack that is to be drawn in and out of the washing space and on which dishes are placed, a nozzle for spraying water for washing dishes, and a sump and a water tank for supplying washing water.

A lower end of the door 72 may be rotatably mounted on the case 71, and the door 72 may be configured to define a front appearance of the dish washer 7 in the state in which the door 72 is closed. The door 72 may include a door body 74 for opening and closing the washing space, and a door panel 73 mounted on the door body 74 and defining a front surface of the door 72.

A body plate 741 may be provided on a front surface of the door body 74 to define a front surface of the door body 74. A side deco 742 extending up and down may be provided along both right and left ends of the door body 74. An upper surface of the door body 74 may be formed by an upper cap deco 743 for connecting upper ends of the side deco 742 at both right and left sides, and a lower surface of the door body 74 may be formed by a lower cap deco 744 for connecting lower ends of the side deco 742 at both right and left sides.

The upper cap deco 743 and the lower cap deco 744 may have the same structure as the upper cap deco 43 and the lower cap deco 44 of the above-described embodiment, only different in size and arrangement. Thus, an accommodation part for coupling with the upper bracket 732 may be formed on the upper cap deco 743, and a catch protrusion for coupling with the lower bracket 733 may be formed on the lower cap deco 744.

The side deco 742 may protrude compared with a front surface of the body plate 741, and a panel accommodating space 741*a* in which the door panel 73 is accommodated may be formed in front of the body plate 741. The door panel 73 may define a front appearance of the dish washer 7 and may be disposed in the panel accommodating space 741*a*.

The lower end of the door panel 73 may be caught and restrained by the lower cap deco 744, and the upper end of the door panel 73 may be coupled to the upper cap deco 743 to fixedly mount the door panel 73 on the front surface of the case 71.

The door panel 73 may have the same structure as the door panel 30 of the above-described embodiment, only different in size as a whole. The door panel 73 may include a panel 731 defining a front surface, the upper bracket 732 mounted at a lower end of the rear surface of the panel 731, and the lower bracket 733 mounted at a lower end of the rear surface of the panel 731.

A mounting part 732*a* accommodated on an accommodation part of the upper cap deco 743 may be formed on the upper bracket 732. A lower mount part 733*a* coupling with the catch protrusion of the lower cap deco 744 may be formed on the lower bracket 733.

A support part for supporting the upper end of the panel 731 may be formed on the upper bracket 732, and a lower support part for supporting the lower end of the panel 731 may be formed on the lower bracket 733 to support the panel 731 and to define an outer appearance of the upper and lower ends of the door panel 73.

Accordingly, in the state in which the door panel 73 is mounted, the door panel 73 may define a neat front appearance of the dish washer 7, and when the door panel 73 is mounted, it may be possible to easily align and firmly mount the door panel 73. In addition, the door panel 73 may be simply separated and mounted to easily change or replace an outer appearance of the dish washer 7.

A buffer member 734 in contact with the body plate 741 may be provided on a rear surface of the panel 731. A magnet 735 to be magnetically attached to the body plate 741 formed of steel may be provided on both right and left sides of the rear surface of the panel 731.

Figure 30:
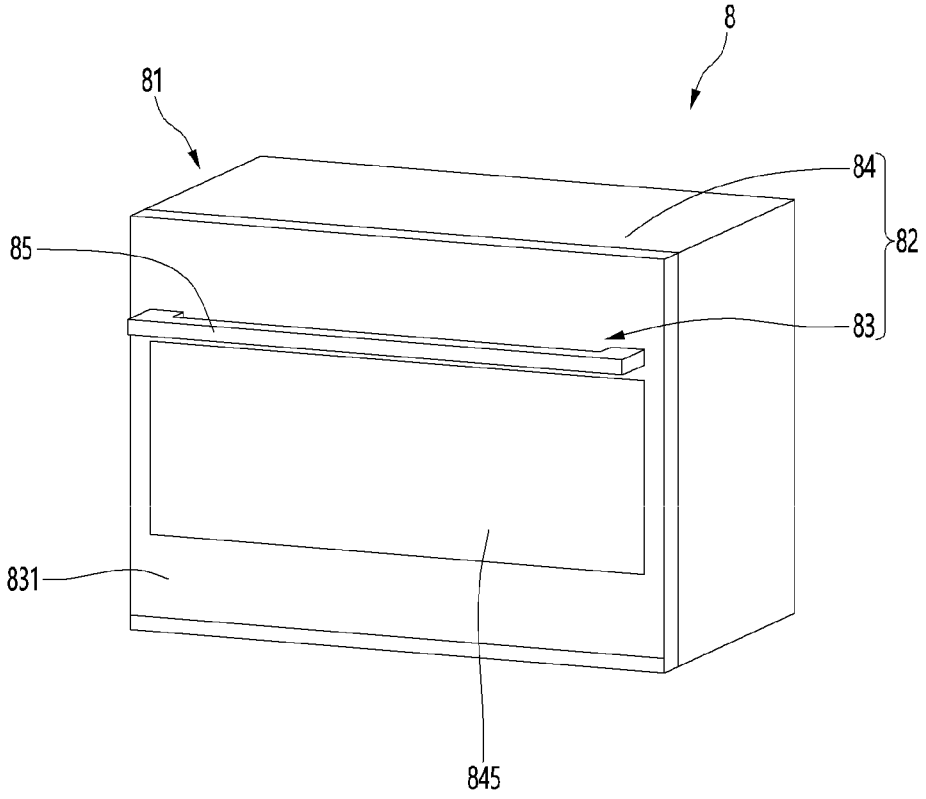
FIG. 30 is a perspective view of a cooking device according to another embodiment of the present disclosure.
Figure 31:
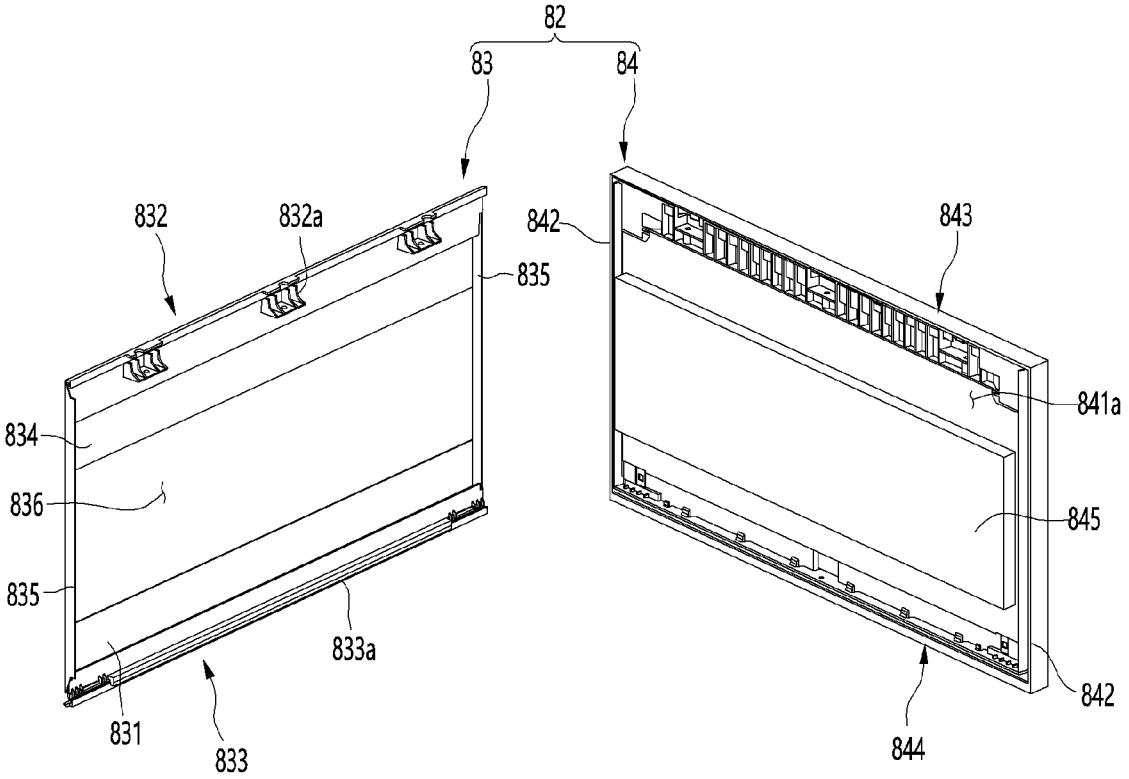
FIG. 31 is an exploded perspective view of a door of the cooking device.

FIG. 30 is a perspective view of a cooking device according to another embodiment of the present disclosure. FIG. 31 is an exploded perspective view of a door of the cooking device.

As shown in the drawing, a cooking device 8 according to another embodiment of the present disclosure may have an outer appearance defined by a case 81 defining a space in which food is accommodated and cooking is performed, and a door 82 for opening and closing an open front surface of the case 81.

Although not shown in detail, in general, the case 81 may have a cooking space therein, a heater or a magnetron for cooking food in the cooking space, a fan for air circulation inside the cooking space, or a turntable on which food is accommodated and rotated.

The door 82 may be rotatably mounted on the case 81 and may be configured to define a front appearance of the cooking device 8 in the state in which the door 82 is closed. The door 82 may include a door body 84 for opening and closing the cooking space, and a door panel 83 mounted on the door body 84 and defining a front surface of the door 82.

A body plate 841 may be provided on a front surface of the door body 84 to define a front surface of the door body 84. A side deco 842 extending up and down may be provided along both right and left ends of the door body 84. An upper surface of the door body 84 may be formed by an upper cap deco 843 for connecting upper ends of the side deco 842 at both right and left sides, and a lower surface of the door body 84 may be formed by a lower cap deco 844 for connecting lower ends of the side deco 842 at both right and left sides.

A sight window 845 for viewing the cooking space may be formed at approximately the center of the door body 84.

The upper cap deco 843 and the lower cap deco 844 may have the same structure as the upper cap deco 43 and the lower cap deco 44 of the above-described embodiment, only different in size and arrangement. Thus, an accommodation part for coupling with an upper bracket 832 may be formed on the upper cap deco 843, and a catch protrusion for coupling with the lower bracket 833 may be formed on the lower cap deco 844.

The side deco 842 may protrude compared with a front surface of the body plate 841, and a panel accommodating space 841*a* in which the door panel 83 is accommodated may be formed in front of the body plate 841. The door panel 83 may define a front appearance of the cooking device 8 and may be disposed in the panel accommodating space 841*a*.

The lower end of the door panel 83 may be caught and restrained by the lower cap deco 844, and the upper end of the door panel 83 may be coupled to the upper cap deco 843 to fixedly mount the door panel 83 on the front surface of the case 81.

The door panel 83 may have the same structure as the door panel 30 of the above-described embodiment, only different in size as a whole. The door panel 83 may include a panel 831 defining a front surface, the upper bracket 832 mounted at a lower end of the rear surface of the panel 831, and the lower bracket 833 mounted at a lower end of the rear surface of the panel 831.

A mounting part 832*a* accommodated on an accommodation part of the upper cap deco 843 may be formed on the upper bracket 832. A lower mounting part 833*a* for coupling with a catch protrusion of the lower cap deco 844 may be formed on the lower bracket 833.

A support part for supporting the upper end of the panel 831 may be formed on the upper bracket 832, and a lower support part for supporting the lower end of the panel 831 may be formed on the lower bracket 833 to support the panel 831 and to define an outer appearance of the upper and lower ends of the door panel 83.

Accordingly, in the state in which the door panel 83 is mounted, the door panel 83 may define a neat front appearance of the cooking device 8, and when the door panel 83 is mounted, it may be possible to easily align and firmly mount the door panel 83. In addition, the door panel 83 may be simply separated and mounted to easily change or replace an outer appearance of the cooking device 8.

A buffer member 834 in contact with the body plate 841 may be provided on a rear surface of the panel 831. A magnet 835 to be magnetically attached to the body plate 841 formed of steel may be provided on both right and left sides of the rear surface of the panel 831.

A panel opening 836 may be formed on the panel 831. The panel opening 836 may be formed with a corresponding size at a position corresponding to the sight window 845. Thus, when a door panel 93 is mounted, a sight window 945 may be exposed forward through the panel opening 836.

A handle 85 for opening and closing the door 82 may be further provided on a front surface of the panel 831.

The following effects may be expected in the refrigerator and the home appliance according to the proposed embodiment.

In the refrigerator according to an embodiment of the present disclosure, a panel bracket may be coupled to an end of a panel defining a front surface of a door, and the panel bracket may support the end of the panel and may simultaneously define an end of the door.

Thus, the end of the pane and a support part of the panel bracket may be mounted on the door body in the state of being in close contact with each other, and an interval is not formed between the pane and the support part and an adhered state therebetween may be maintained. Due to this structure, viewed from the front, the door panel may maintain an outer appearance in the state in which the end of the pane and the support part are in close contact with each other, and accordingly, an outer appearance may be advantageously improved and assembly finish quality may be advantageously improved.

In particular, the door bracket may be already attached to the panel to complete the finish before the door panel is mounted, and accordingly, even after the door panel is mounted on the door body, the interval between the panel and the support part may not be widened or deformed, and the state in which the panel and the support part are first coupled may be maintained, thereby advantageously maintaining the finished quality.

When the panel is formed of a metal plate, a bending part bent at an end of the pane may be covered by attaching the panel bracket. Accordingly, it may be possible to prevent a user from being injured by a sharp end of the panel during a transporting and assembling process for mounting the door panel, and the work safety of an operator may be advantageously ensured.

An end of the panel may be supported by the support part, and thus may be prevented from being directly exposed to the outside. Thus, even if an external impact is applied to an end of the door panel, the door panel may be protected by the support part, and the panel may be advantageously prevented from being damaged.

The door panel may be disposed at an end of a rear surface of the panel bracket in the state of being mounted on the door body, and the panel bracket may be supported by a front surface of the upper cap deco of the door. Thus, even if a load is applied to the end of the door panel or the door panel is compressed and pressed, the door panel may be supported by the upper cap deco from the rear, thereby advantageously preventing the panel from being deformed and damaged.

The door panel may be configured in such a way that a mounting part protruding from the panel bracket is accommodated on an accommodation part of the upper cap deco in the state in which the panel bracket is mounted. In this case, the mounting part and the accommodation part may be coupled to each other, and the door panel may be aligned at an accurate position without a separate correction and alignment operation through an operation of accommodating the mounting part on the accommodation part and may become in the state in which it is possible to mount the door panel.

Accordingly, an operator may align the position of the door panel and may fixedly mount the door panel through a simple operation of accommodating the mounting part on the accommodation part, thereby advantageously improving work convenience and productivity.

In particular, the mounting part may be integrally formed with the support part together with the support part for supporting the panel, and an outer appearance of the door may be formed by the panel bracket, and the door panel may also be fixedly mounted. Accordingly, the number of parts in the product may be reduced, and manufacturing cost may also be advantageously reduced.

What is claimed is:

1. A refrigerator comprising:

a cabinet that defines a storage space therein; and a door assembly configured to open and close at least a portion of the storage space, the door assembly comprising (i) a door body that accommodates an insulator and (ii) a door panel that is detachably disposed at a front surface of the door body, wherein the door panel comprises:

a front panel that defines a front appearance of the door assembly, and a plurality of panel brackets disposed at a rear surface of the front panel and configured to couple the door panel to the door body, the plurality of panel brackets comprising (i) an upper bracket disposed at an upper end of the door panel and (ii) a lower bracket disposed at a lower end of the door panel, and wherein each of the upper bracket and the lower bracket is a single body that comprises:

a coupling part having a front surface that is coupled to the rear surface of the front panel, a support that extends along an end of the coupling part and supports an end of the front panel, the support defining an upper appearance or a lower appearance of the door panel, and a mounting protrusion that protrudes rearward from a rear surface of the coupling part and is configured to be coupled to the door body.

2. The refrigerator of claim 1, wherein the support is configured to, based on the door panel being coupled to the door body, be disposed at a position corresponding to an upper or lower end of the door body.

3. The refrigerator of claim 2, wherein the support has a rear end that is configured to, based on the door panel being coupled to the door body, be in contact with a front end of the door body.

4. The refrigerator of claim 1, wherein the support protrudes forward to a position corresponding to a front surface of the front panel.

5. The refrigerator of claim 1, wherein a thickness of the support decreases as the support extends forward to the front panel.

6. The refrigerator of claim 5, wherein the support has:

a first surface that is in contact with the end of the front panel and parallel to the front panel, and a second surface that is opposite to the first surface of the support, the second surface being inclined with respect to the first surface or rounded.

7. The refrigerator of claim 1, wherein the front panel comprises a metal plate comprising:

a panel front part that defines a front surface of the front panel; and bending parts that are curved rearward from the panel front part and extend along upper and lower ends of the panel front part, the bending parts being configured to be in contact with the support, and wherein the support defines an accommodating groove that is recessed from and extends along a front side of the support, the accommodating groove being configured to receive the bending parts.

8. The refrigerator of claim 1, wherein the support protrudes forward from the coupling part to the front panel.

9. The refrigerator of claim 8, wherein a protrusion length of the support from the coupling part corresponds to a thickness of the front panel.

10. The refrigerator of claim 1, wherein the coupling part is adhered to the front panel by an adhesive.

11. The refrigerator of claim 1, wherein the door body comprises an upper cap deco that defines an upper surface of the door body, and wherein an upper surface of the upper bracket is flush with an upper surface of the upper cap deco.

12. The refrigerator of claim 11, wherein the door body further comprises a side deco that defines side surfaces of the door body, wherein the side deco comprises a side support that protrudes from a front end of the side deco toward the front panel and is configured to support a right or left end of the front panel, and wherein a protruding length of the side deco toward the front panel is equal to a protruding length of the support toward the front panel.

13. The refrigerator of claim 12, wherein the side support protrudes forward to the front panel relative to the upper cap deco.

14. The refrigerator of claim 11, wherein the upper cap deco comprises:

an upper part that defines the upper surface of the door body; and a front part that supports the coupling part from a rear side of the coupling part, and wherein the front part of the upper cap deco defines an accommodation recess that is recessed from the front part and has a size and a shape corresponding to the mounting protrusion to thereby receive the mounting protrusion therein.

15. The refrigerator of claim 14, wherein an end of the upper bracket is flush with an end of the upper cap deco based on the mounting protrusion being coupled to the accommodation recess.

16. The refrigerator of claim 14, wherein the accommodation recess comprises:

an accommodation part support surface that supports a bottom surface of the mounting protrusion and defines an accommodation part screw hole configured to couple to the mounting protrusion; and an accommodation part edge that extends upward along a perimeter of the accommodation part support surface and is in contact with a perimeter of the mounting protrusion.

17. The refrigerator of claim 16, wherein the mounting protrusion comprises:

a mounting protrusion support surface that extends along the coupling part and is supported by the accommodation part support surface, the mounting protrusion support surface defining a mounting protrusion screw hole configured to couple to the accommodation part screw hole; and a plurality of reinforcing ribs that connect the mounting protrusion support surface to the coupling part.

18. The refrigerator of claim 17, wherein the upper cap deco defines a deco opening at the upper surface of the upper cap deco, the deco opening being open to the accommodation recess, and wherein the refrigerator further comprises a deco cover that is configured to cover the deco opening based on the mounting protrusion being coupled to the accommodation recess.

19. The refrigerator of claim 14, wherein the upper bracket further comprises a shielding part that protrudes reward from an upper end of the coupling part toward the mounting protrusion, the shielding part covering at least a portion of an open upper side of the accommodation recess.

20. The refrigerator of claim 11, wherein the door assembly further comprises a lower cap deco that defines a lower surface of the door assembly, and wherein a lower surface of the lower bracket is flush with a lower surface of the lower cap deco.

* * * * *